US005597084A

United States Patent [19]

Parasin

[11] Patent Number: 5,597,084

[45] Date of Patent: Jan. 28, 1997

[54] COLLAPSIBLE PALLET BIN

[75] Inventor: Alexander V. Parasin, Vancouver, Canada

[73] Assignee: Canadian Plywood Association, North Vancouver, Canada

[21] Appl. No.: 390,614

[22] Filed: Feb. 17, 1995

[51] Int. Cl.[6] ..... B61D 9/00

[52] U.S. Cl. ..... 220/4.28; 220/4.33; 206/600

[58] Field of Search ..... 220/4.28, 4.33, 220/4.34, 1.5; 206/380, 577, 600

[56] References Cited

U.S. PATENT DOCUMENTS

| | | | |
|---|---|---|---|
| 1,224,234 | 5/1917 | Taber | 220/4.28 |
| 1,481,561 | 1/1924 | Ringer | 220/4.28 |
| 3,589,547 | 6/1971 | Hambleton . | |
| 4,171,058 | 10/1979 | Collins . | |
| 4,807,774 | 2/1989 | Karpisek . | |
| 4,830,211 | 5/1989 | Efird . | |
| 4,884,686 | 12/1989 | Dupuis | 220/4.28 |
| 4,917,255 | 4/1990 | Foy et al. . | |
| 4,948,005 | 8/1990 | Garton et al. . | |
| 5,161,709 | 11/1992 | Oestreich, Jr. . | |
| 5,246,128 | 9/1993 | Uitz . | |
| 5,415,310 | 5/1995 | Simms | 220/4.28 |

FOREIGN PATENT DOCUMENTS

| | | |
|---|---|---|
| B-44120/85 | 9/1988 | Australia . |
| 4330627A1 | 10/1994 | Germany . |
| 2249540 | 5/1992 | United Kingdom . |
| WO92/02425 | 2/1992 | WIPO . |

*Primary Examiner*—Joseph M. Moy

*Attorney, Agent, or Firm*—Townsend and Townsend and Crew

[57] ABSTRACT

A container comprising a base, a pair of side walls, and first and second end walls. The pair of side walls are releasably connectable to the base by slidable movement from a first position to an intermediate position and then to a final position. The side walls are releasably connectable to the first and second end walls. The first end wall is releasably connectable to the base after the first end wall has been connected to the side walls when the side walls are in their intermediate position by slidable movement of the pair of side walls and the first end wall as a unit over the base to the final position of the side walls. After connection of the first end wall and side walls to the base, the second end wall is releasably connected to the side walls to complete the container. Interlocking three of the four walls to the base provides a container that is very strong and damage resistant. The container is also quick and simple to assemble and requires no tools.

21 Claims, 22 Drawing Sheets

COLLAPSIBLE PALLET BIN

FIELD OF THE INVENTION

This invention relates to a container for carrying goods.

BACKGROUND OF THE INVENTION

Shipping containers for transporting goods to a destination must be sturdy and resistant to damage. This requirement for a sturdy container is at odds with the current design practice of making containers collapsible to be broken down after the goods have been removed. Delivering the container back to the point of origin in a collapsed state takes up less space than the empty, fully assembled container.

Many collapsible container designs have been developed in an attempt to provide a container that is strong and damage resistant and yet is capable of being broken down again and again for unlimited re-use.

U.S. Pat. No. 5,246,128 to Uitz discloses a plastic container and pallet system in which the various component walls are glued or vibration welded together.

U.S. Pat. No. 3,589,547 to Hambleton discloses a container system that uses corrugated metal panels. The end panels are anchored to the base of the container and support the side panels which slidably interlock with the end panels.

U.S. Pat. No. 4,807,774 to Karpisek discloses a special container designed particularly for carrying liquids in a sealed liner within the container. Karpisek uses a base member formed with special joints that permit rotation and linear movement of four side walls from a folded position to an upright position.

U.S. Pat. No. 4,830,211 to Efird discloses a collapsible storage container that employs special side panel that include a cable and turn buckles to tighten together component sub-panels to tension and stabilize the unit.

U.S. Pat. No. 4,917,255 to Foy et al discloses a collapsible plastic container which uses hinged walls attached to the base so that the walls can be folded onto the base.

U.S. Pat. No. 4,948,005 to Garton et al discloses a plastic shipping and storage container constructed from multiple panels The panels use a unique latching mechanism that allows individual panels to be connected side by side in a single plane or at 90°.

U.S. Pat. No. 5,161,709 to Oestreich, Jr. discloses a collapsible container that relies on hinges to allow the side walls to be folded on to the base into a compact form.

U.S. Pat. No. 4,171,058 to Collins discloses a knock-down container of very simple design that relies on slotted engagement of the various side walls to define an enclosed space.

SUMMARY OF THE INVENTION

The present invention provides a collapsible and reusable container that is extremely strong and resistant to damage. The container of the present invention relies on slidable engagement of three walls with the base and with each other to produce a design that is quick to assemble or collapse and that offers superior strength and rigidity. Prior container designs that rely on sliding engagement of the walls and base, such as that disclosed in U.S. Pat. No. 3,589,547 to Hambleton, tend to rely on anchoring of two initial walls to the base. Additional walls are not directly connected to the base but are slidably connected to the two initial walls. This arrangement permits movement of the additional walls with respect to the base. Testing by the applicant involving dropping of containers from a short distance has revealed that containers constructed with only two of four walls anchored to the base tend to be subjected to warping of the walls, particulary when dropped on a corner of the container. This warping can compromise the integrity of the container or permanently bend some of the component walls making the container difficult to collapse and requiring replacement of the affected walls.

The container of the present invention is designed to allow for the convenience and ease of slidable engagement of the walls with the base while providing an interlocking arrangement of walls and base that improve the overall rigidity of the container to render it capable of surviving the drop test mentioned above.

Accordingly, the present invention provides a container comprising:

a base, a pair of side walls, and first and second end walls;

means for releasably connecting the pair of side walls to the base by slidable movement of the side walls from a first position to an intermediate position and then to a final position on the base;

means for releasably connecting the side walls to the first and second end walls; and means for releasably connecting the first end wall to the base after the first end wall has been connected to the side walls when the side walls are in their intermediate position by slidable movement of the pair of side walls and the first end wall as a unit over the base to the final position of the side walls whereupon the second end wall is releasably connected to the side walls atop the base to complete the container.

The container of the present invention has no loose parts and requires no tools for assembly or collapse.

Preferably, the container is provided with a cover to fit over the open top of the container to enclose the interior. The cover is slidably engagable with the body of the container and preferably includes a locking system to secure the cover to the container for safe storage of the contents.

The component walls and base of the container are preferably made from plywood panels for high strength and low weight. Other materials such as oriented strandboard, plastic or sheet steel can also be used. The components for joining the walls and base are preferably made from steel or light weight alloy, however, other materials such as high strength plastic can be used.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
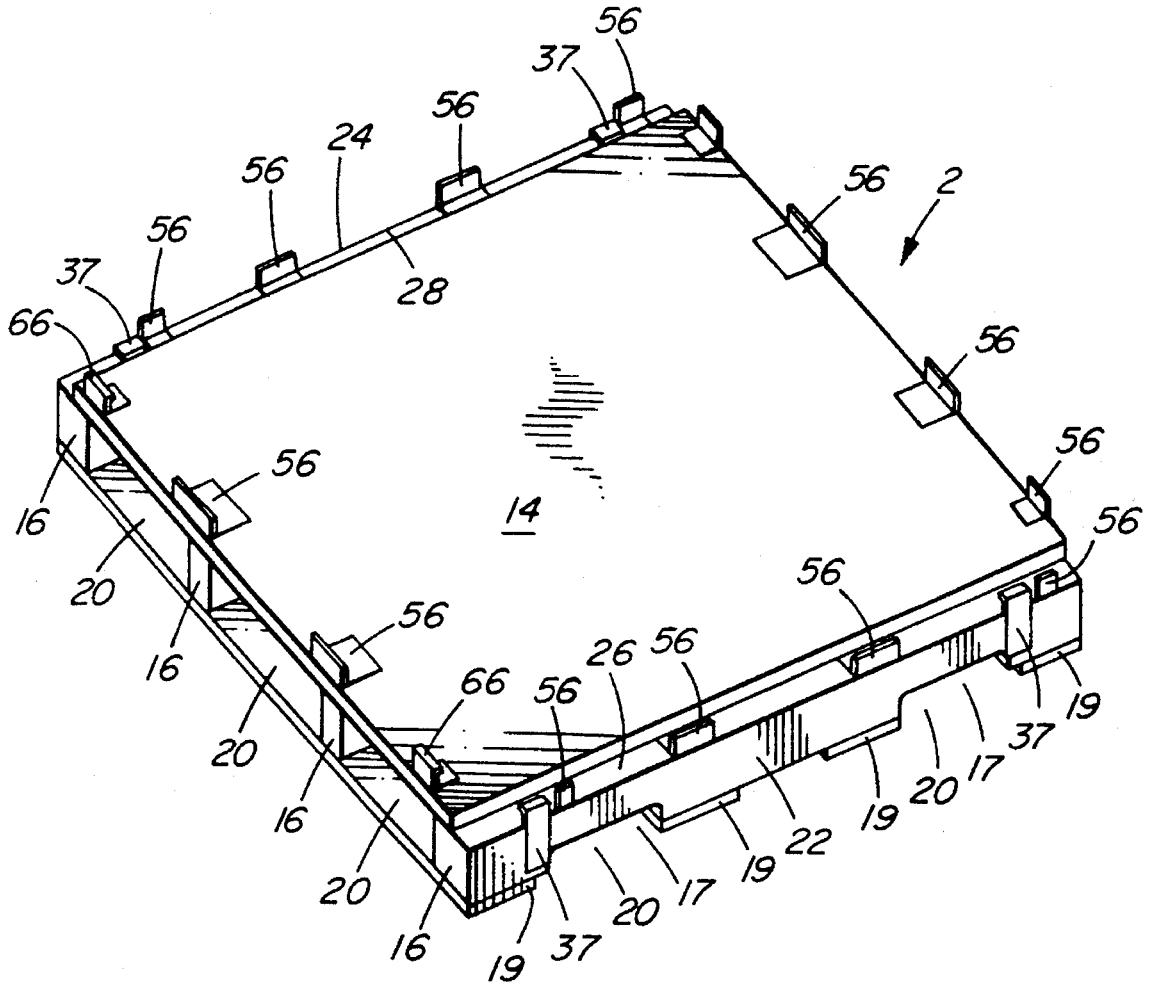
FIG. 1 is a perspective view of the base of the container of the present invention.

A preferred embodiment of the container of the present invention is illustrated in the drawings. The container comprises a base 2, a pair of side walls 4 and 6, a first end wall 8, a second end wall 10 and a cover 12. Preferably, the various panels of the container are formed from wood, such as plywood or oriented strandboard, which is strong and rigid yet relatively lightweight. Alternatively, the panels can be formed from such materials as plastic or sheet metal.

Base 2 is illustrated in FIG. 1. Base 2 is preferably of rectangular shape and comprises a pallet formed from a top panel 14 that is mounted to a plurality of spaced, parallel crosspieces 16. Crosspieces 16 are also formed with aligned and spaced cut outs 17. A series of spaced, parallel lower bracing members 19 extend at right angles to crosspieces 16. The crosspieces 16 and cutouts 17 define passages 20 extending between opposite sides of the base to receive the tines of fork lift equipment and permit lifting of the container from any of its four sides.

Side edges 22 and 24 of base 2 are formed with slots 26 and 28, respectively, that are adapted to guide the movement of side walls 4 and 6 of the container during their connection to the base as will be more fully explained below.

Figure 2A:
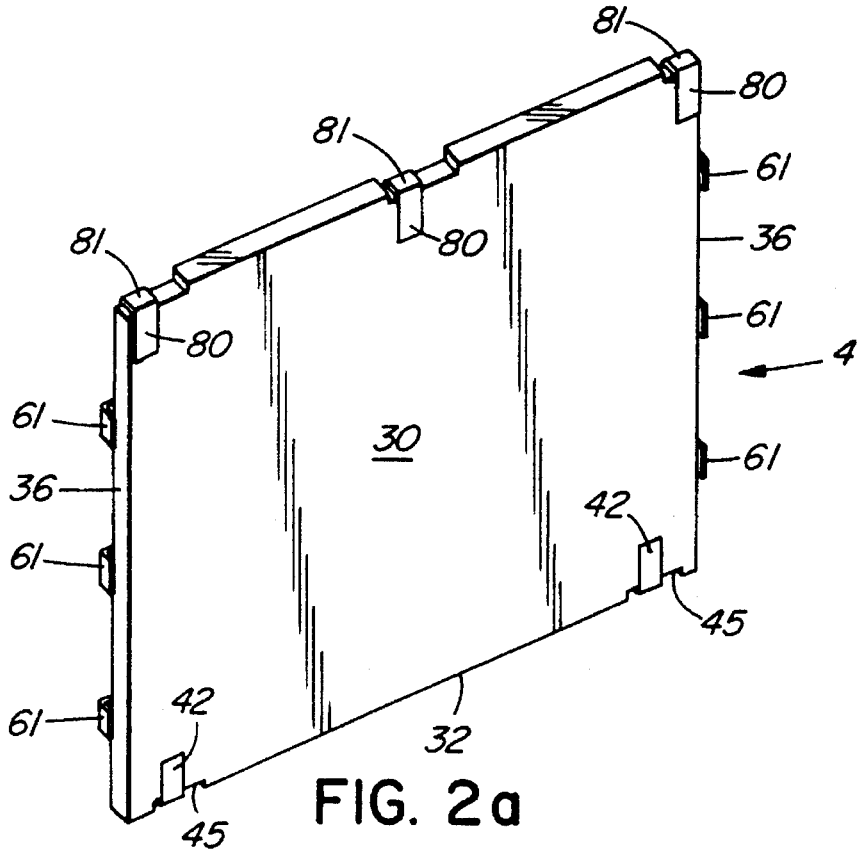
FIGS. 2*a* and 2*b* are perspective views of a side wall of the container.
Figure 2B:
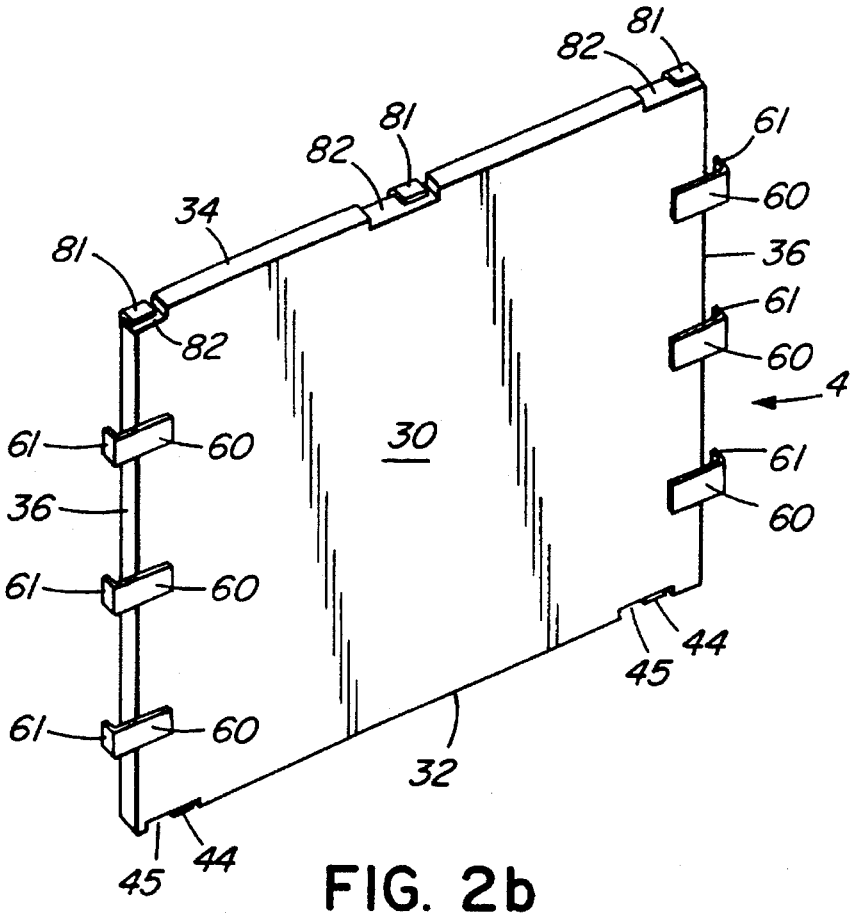

FIGS. 2*a* and 2*b* show inner and outer surfaces, respectively, of side wall 4 for engagement in slot 26 of base 2 as shown in FIG. 1. Side wall 6 for engagement in slot 28 of the base is a mirror image of side wall 4. Each side wall comprises a substantially rectangular panel 30 having a lower edge 32, an upper edge 34 and side edges 36.

Figure 3A:
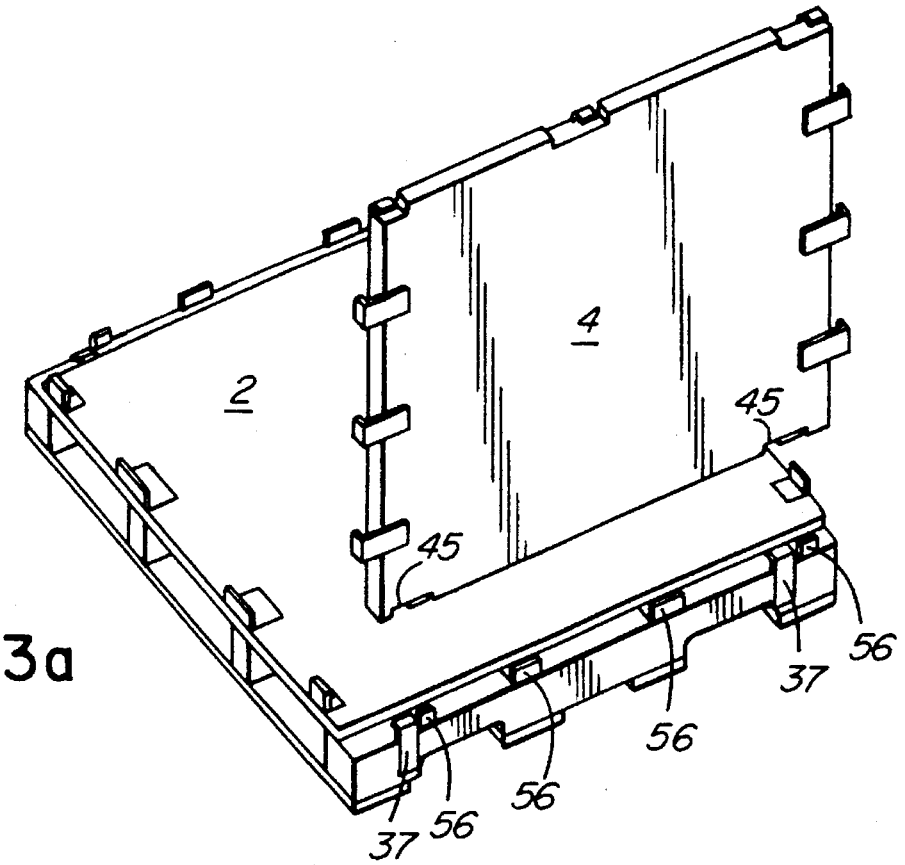
FIGS. 3*a*, 3*b* and 3*c* are views showing engagement of a side wall with the base and slidable movement to the intermediate position.
Figure 3D:
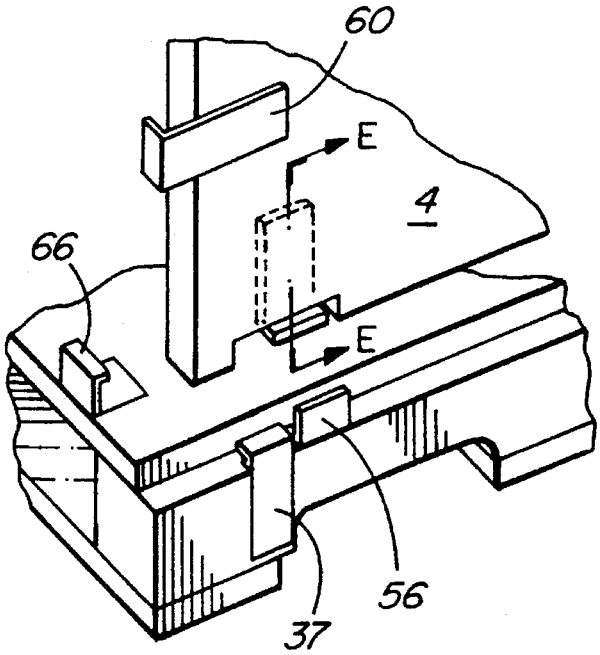
FIG. 3*d* is a detail view of FIG. 3*a;*

Means for releasably connecting the side walls to the base are provided adjacent the lower edges 32 of the side walls and in slots 26 and 28 of the base. The means for releasably connecting the side walls to the base comprise channel means and channel engaging members mounted to the base and side walls. As best shown in FIG. 3*g*, which is a detail view looking along the side edge 22 of base 2, the channel means preferably comprise at least two spaced, angle members 37 positioned adjacent slots 26 and 28 on the base. Each angle member 37 has an upper inwardly extending flange 38 that extends over the slot of the base in spaced, parallel relation thereto to create a channel 40 between the flange and the base.

Figure 3E:
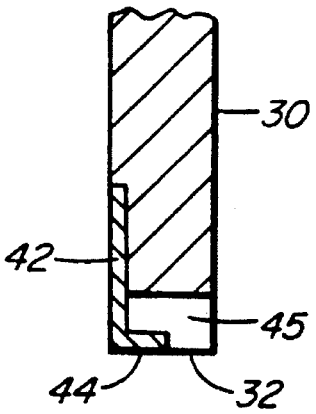
FIG. 3*e* is a detail section view taken along line E—E of FIG. 3*d;*

Referring to FIG. 3*e* and FIG. 2*a* and 2*b*, the channel engaging members preferably comprise at least two spaced, L-shaped angle members 42 mounted to panel 30 of side wall 4 adjacent lower edge 32 and positioned to engage with corresponding angle members 37. Each angle member 42 has a lower outwardly extending flange 44 for slidable engagement in the channels 40 defined by the angle members 37. As best shown in FIG. 3*e*, each angle member 42 is mounted at an end of a cavity 45 formed on lower edge 32. The opposite end of the cavity is open. Cavity 45 extends a distance along lower edge 32 equal to at least the combined length of flange 44 of angle member 42 and flange 38 of angle member 37 to permit introduction of the angle member into the open end of cavity 45 prior to sliding of the side wall with respect to the base.

Angle members 37 and 42 are preferably formed from steel and attached to the plywood of the base and side walls by conventional threaded fasteners. In fact, all the various connecting hardware of the present embodiment is preferably formed from steel or a suitable lightweight alloy attached to the wooden panels of the base, walls and cover by threaded fasteners. This arrangement makes it easy to remove and replace individual hardware components in the event that a particular component is damaged.

Figure 3B:
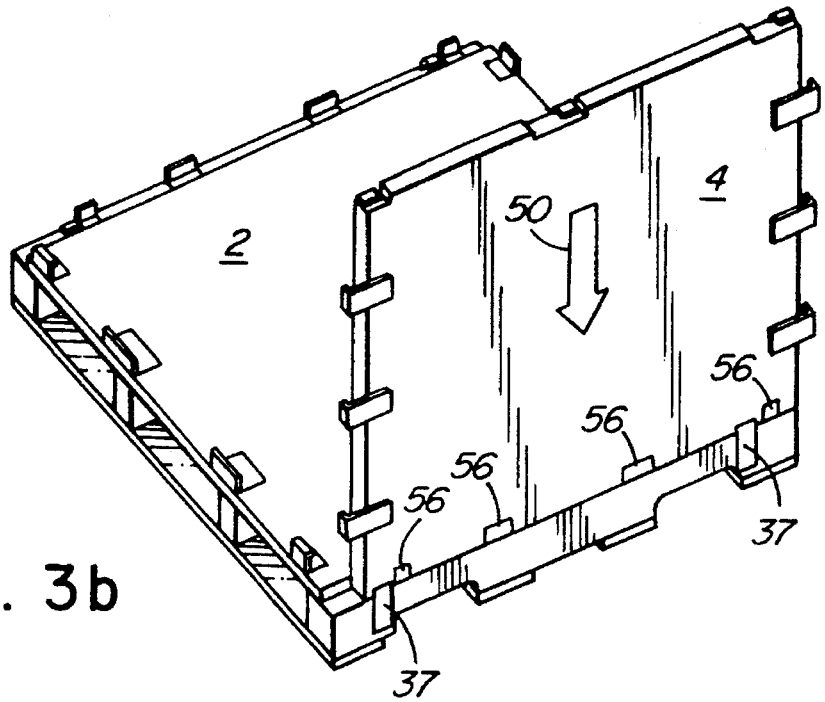
Figure 3F:
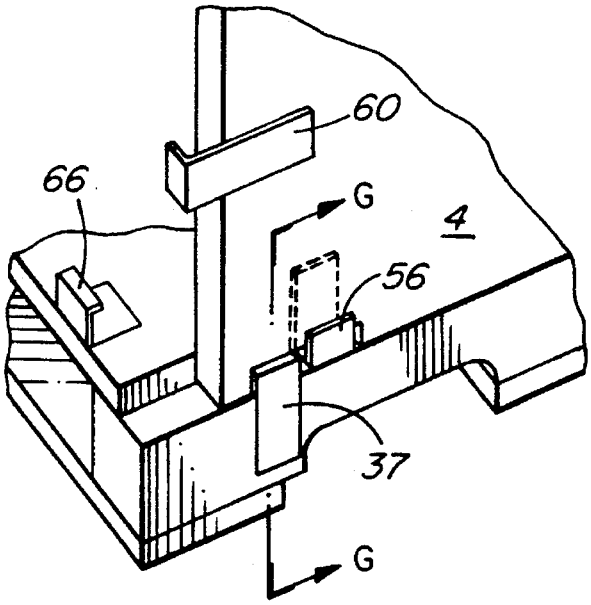
FIG. 3*f* is a detail view of FIG. 3*b;*
Figure 3G:
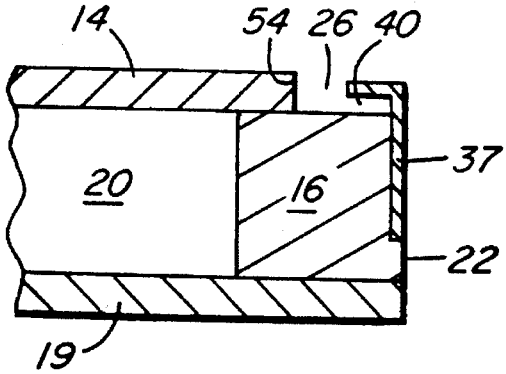
FIG. 3*g* is a detail section view taken along line G—G of FIG. 3*f;*
Figure 3C:
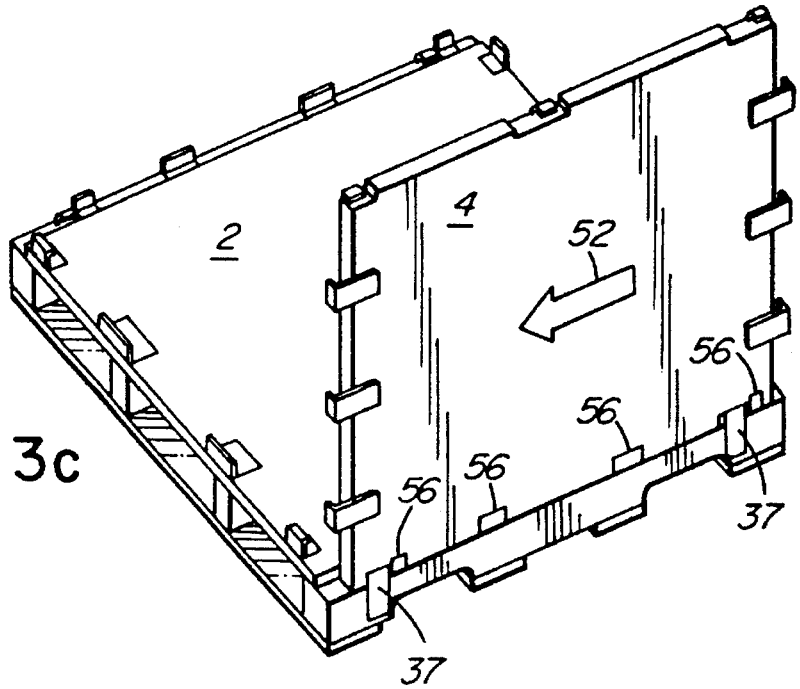
Figure 3H:
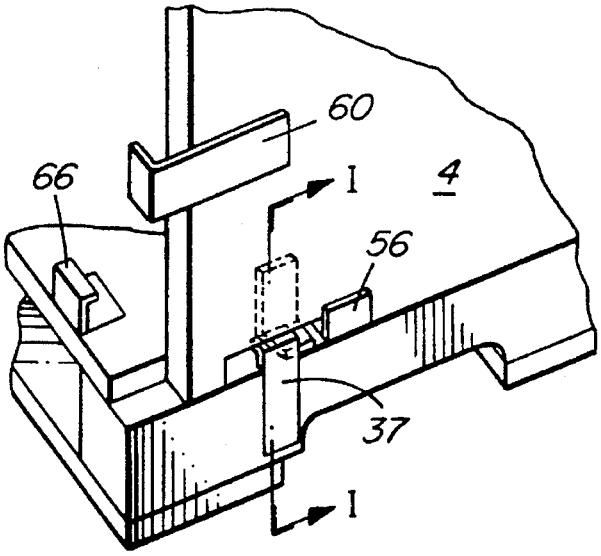
FIG. 3*h* is a detail view of FIG. 3*c;*
Figure 3I:
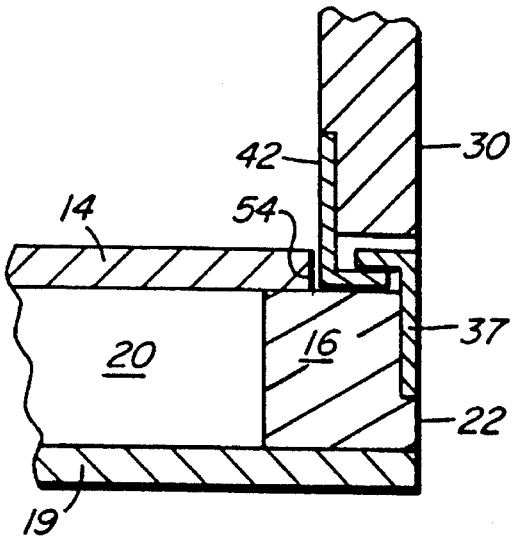
FIG. 3*i* is a detail section view taken along line I—I of FIG. 3*h;*

FIGS. 3*a*–3*i* shows the steps involved in connecting side wall 4 to the base. Initially, side wall 4 is lifted into place over base 2 such that the open ends of cavities 45 in lower edge 32 are aligned over angle members 37 (FIGS. 3*a* and 3*d*). Then, side wall 4 is lowered in the direction of arrow 50 onto the base so that each angle member 37 is introduced into corresponding cavity 45. This defines the initial position of the side wall on the base (FIGS. 3*b* and 3*f*). Side wall 4 is then slid sideways in the direction of arrow 52 over the base to an intermediate position, as best shown in FIG. 3*h*, in which each angle member 42 is partially engaged in channel 40 defined by angle member 37. In this intermediate position, the side wall is interlocked with the base so that the side wall extends substantially perpendicular to the base (FIGS. 3*c* and 3*h*). As best shown in FIG. 3*i*, slot 26 acts as a guide to control movement of the side wall over the base. Slot 26 defines a first substantially vertical surface 54 to prevent inward movement of the side wall with respect to the base. The horizontal lower surface 55 of slot 26 supports lower edge 32 of the side wall. In addition, a plurality of spaced, upstanding tabs 56 co-operate to define a second substantially vertical surface to prevent outward movement of the side wall with respect to the base.

The other side wall 6 is connected to the opposite side of the base in exactly the same manner and positioned in the same intermediate position in preparation for receiving the first end wall 8.

Figure 4A:
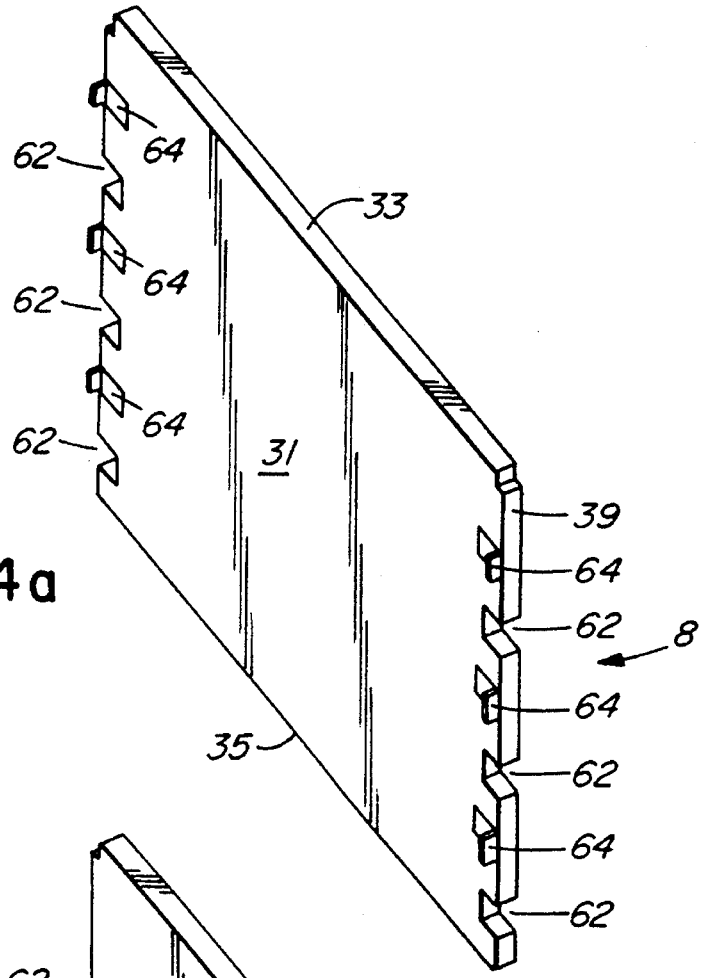
FIGS. 4*a* and 4*b* are perspective views of the first end wall of the container.
Figure 4B:
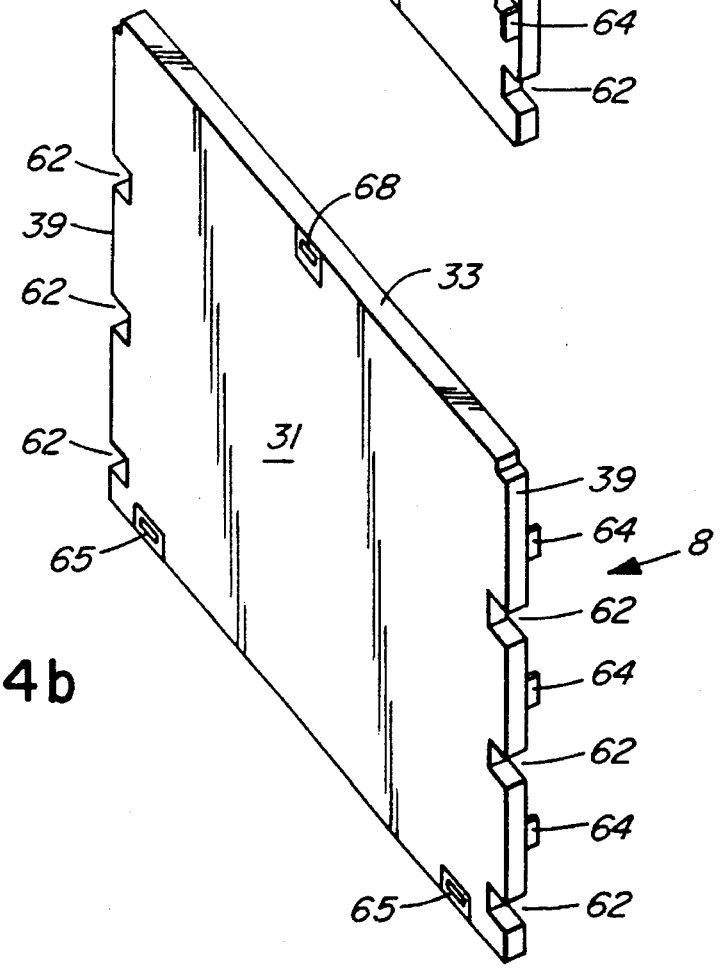

FIGS. 4*a* and 4*b* show inner and outer views, respectively, of first end wall 8. First end wall 6 comprises a panel 31 dimensioned to interfit between the side walls on base 2 and having top edge 33, bottom edge 35 and side edges 39. Means for releasably connecting the side walls to the first end wall are provided in the form of channels means along the side edges 36 of the side walls 4 and 6 adapted to slidably receive the side edges 39 of the first end wall.

Referring to FIG. 2*b*, the channel means comprise a plurality of L-shaped members 60 mounted at spaced intervals adjacent the side edges 36 of each side wall. Each member 60 has a terminal flange 61 extending parallel to side edge 36 of the side wall to define a pocket between the flange and the side edge for receiving and retaining a portion of the side edge 39 of the first end wall. In addition, first end wall 8 is formed with a plurality of cutaway sections 62 in side edges 39 that are dimensioned and positioned to accommodate movement of the first end wall side edges past L-shaped members 60 for alignment of the first end wall with the channel defined by the L-shaped members. Furthermore, bracing means in the form of a plurality of angle members 64 mounted adjacent side edges 39 are provided on first end wall 10. Angle members 64 are adapted to engage against the exterior surface of adjacent side walls when the side walls and end wall are joined to brace the side walls to prevent outward movement with respect to the base.

The container also includes means for releasably connecting the first end wall 8 to the base comprising at least one cavity 65 and at least one hook member 66 formed on the first end wall and the base. As illustrated in FIG. 1 and FIG. 4*b*, in the preferred embodiment, a pair of cavities 65 are formed in the first end wall adjacent lower edge 35 and a corresponding pair of hook members 66 are mounted to the base.

Preferably, the base also includes upstanding tabs 56 along its edge adjacent the first end wall. Tabs 56 engage against the external surface of the end wall to provide additional bracing to prevent outward movement of the wall with respect to the base.

FIGS. 5*a*–5*h* illustrate the steps necessary to connect first end wall 8 to side walls 4 and 6 already in place in the intermediate position on base 2.

Figure 5A:
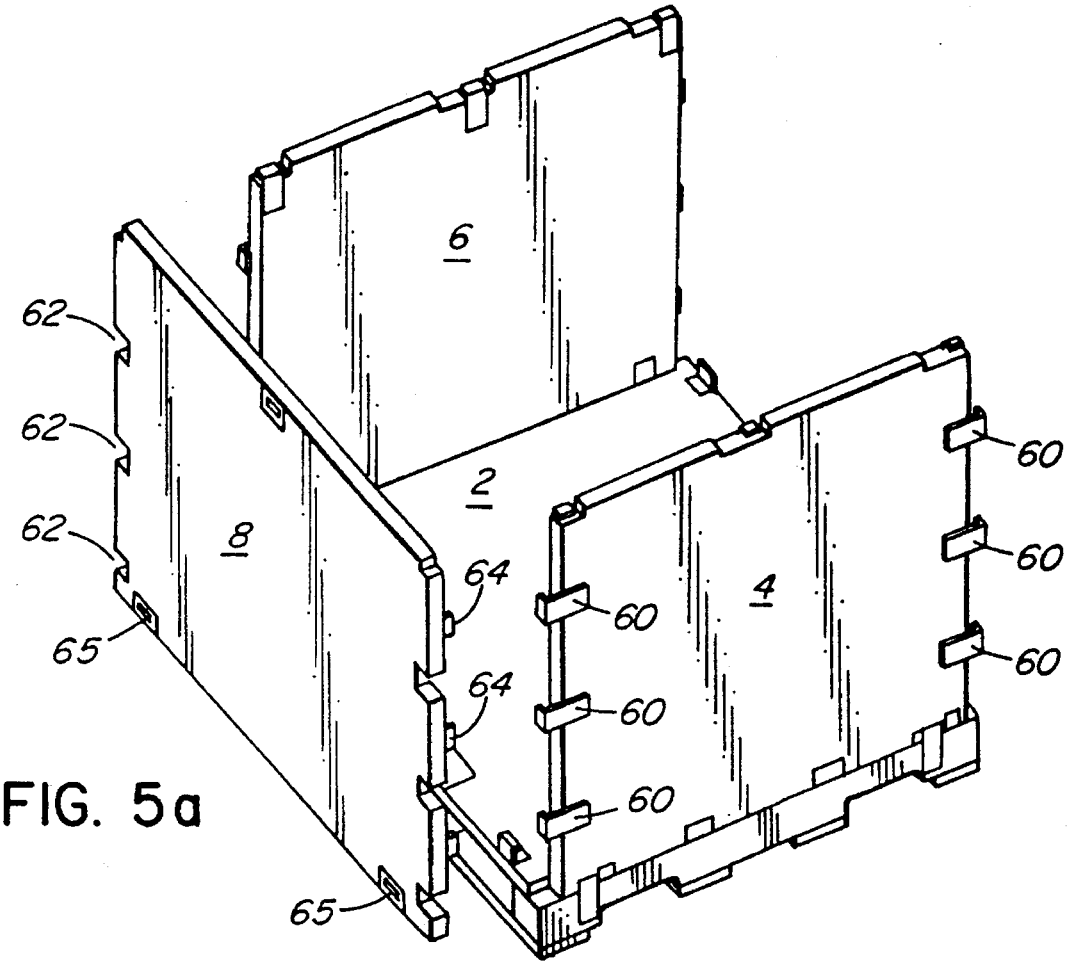
FIGS. 5*a*, 5*b*, 5*c*, 5*d* are views showing engagement of the first end wall with the side walls and movement of the first end wall and the side walls to the final position.
Figure 5E:
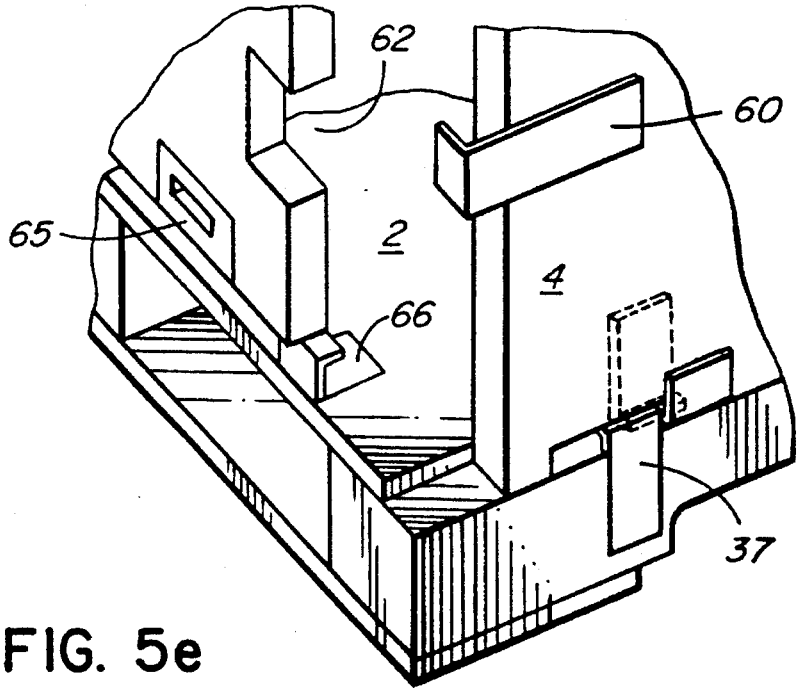
FIGS. 5*e*–5*h* are detail views of the steps illustrated in FIGS. 5*a*–5*d;*
Figure 5B:
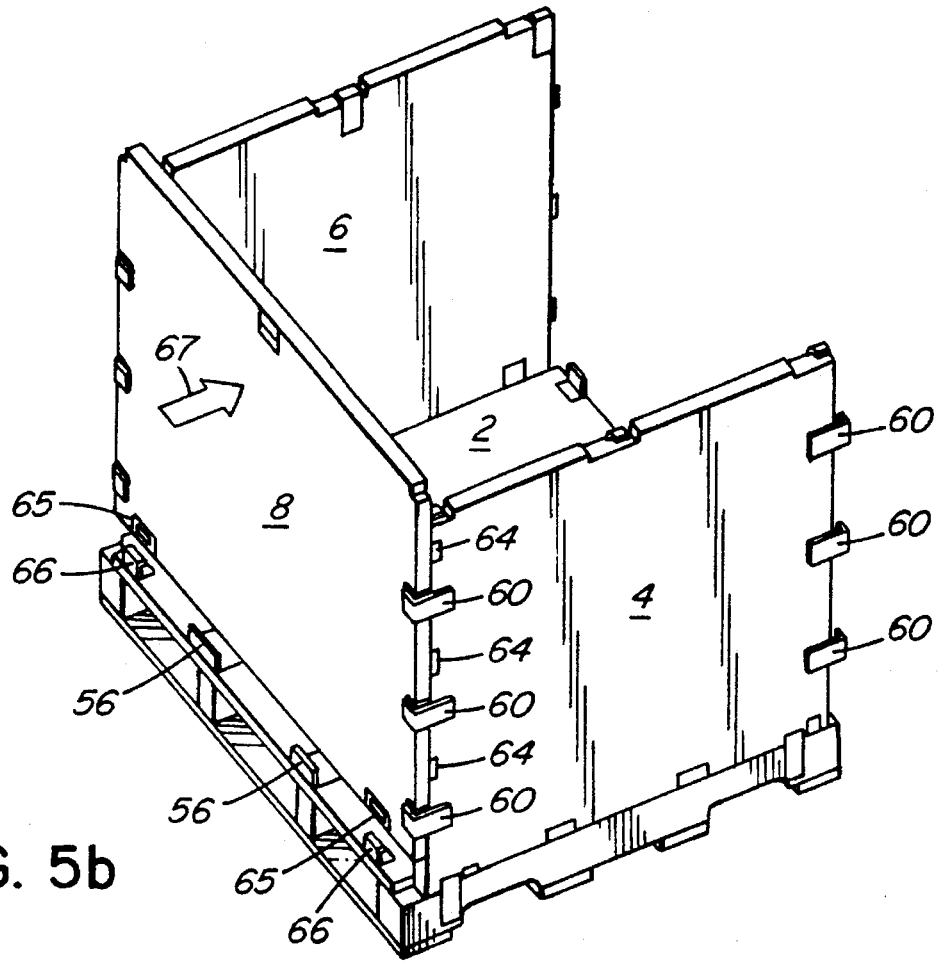
Figure 5F:
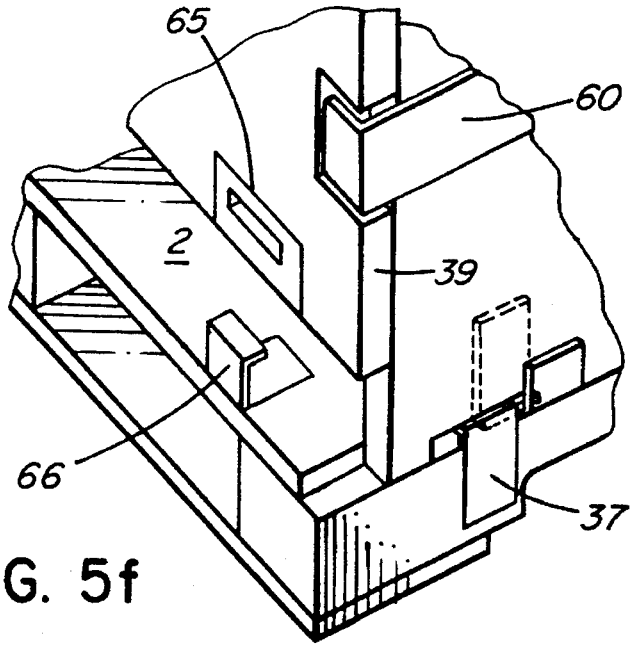

Initially, first end wall 8 is raised into position to align cut away section 62 with the L-shaped members 60 of the side walls (FIGS. 5*a* and 5*e*). First end wall is then moved inwardly as indicated by arrow 67 in FIG. 5*b* so that the L-shaped members 60 pass through cut away section 62 and the side edges 39 of first end wall 8 are introduced into the channel defined by the L-shaped members (FIGS. 5*b* and 5*f*).

Figure 5C:
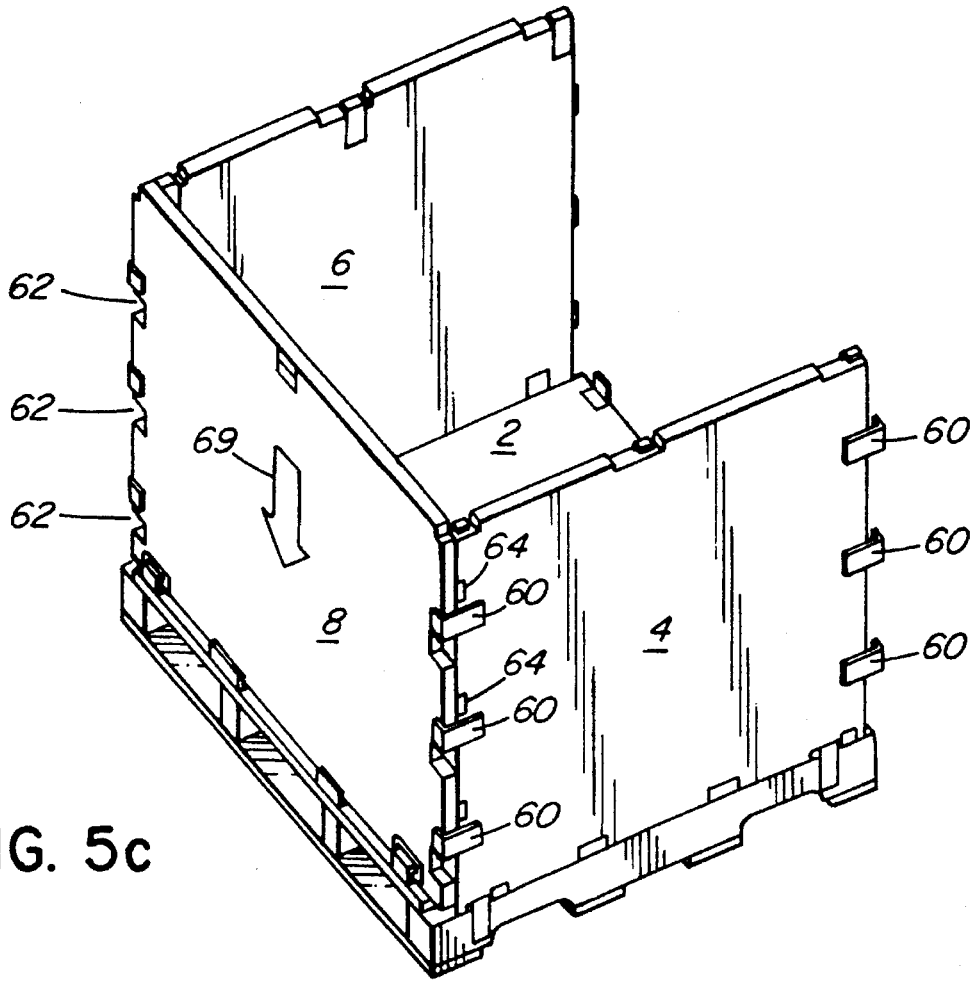
Figure 5G:
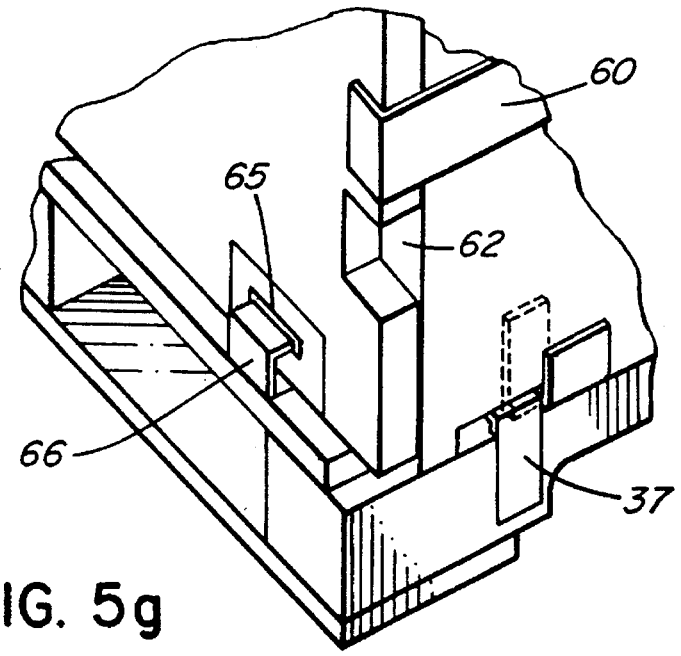

First end wall 8 then slides downwardly in the channels as indicated by arrow 69 in FIG. 5*c* until the end wall engages with the base. As shown in FIG. 5*g*, downward movement of the first end wall to the base misaligns L-shaped members 60 and cut away sections 62 so that the L-shaped members engage the external surface of the end wall. At the same time, angle members 64 of the end wall engage the external surface of the side walls to interlock the end wall and the side wall as a single unit. Note in FIG. 5*g* that the intermediate position of side walls 4 and 6 places the side edge 36 of each side wall a sufficient distance from the end of slot 26 on base 2 that first end wall 8 is able to clear hook member 66 when it is slid downwardly to the base.

Figure 5D:
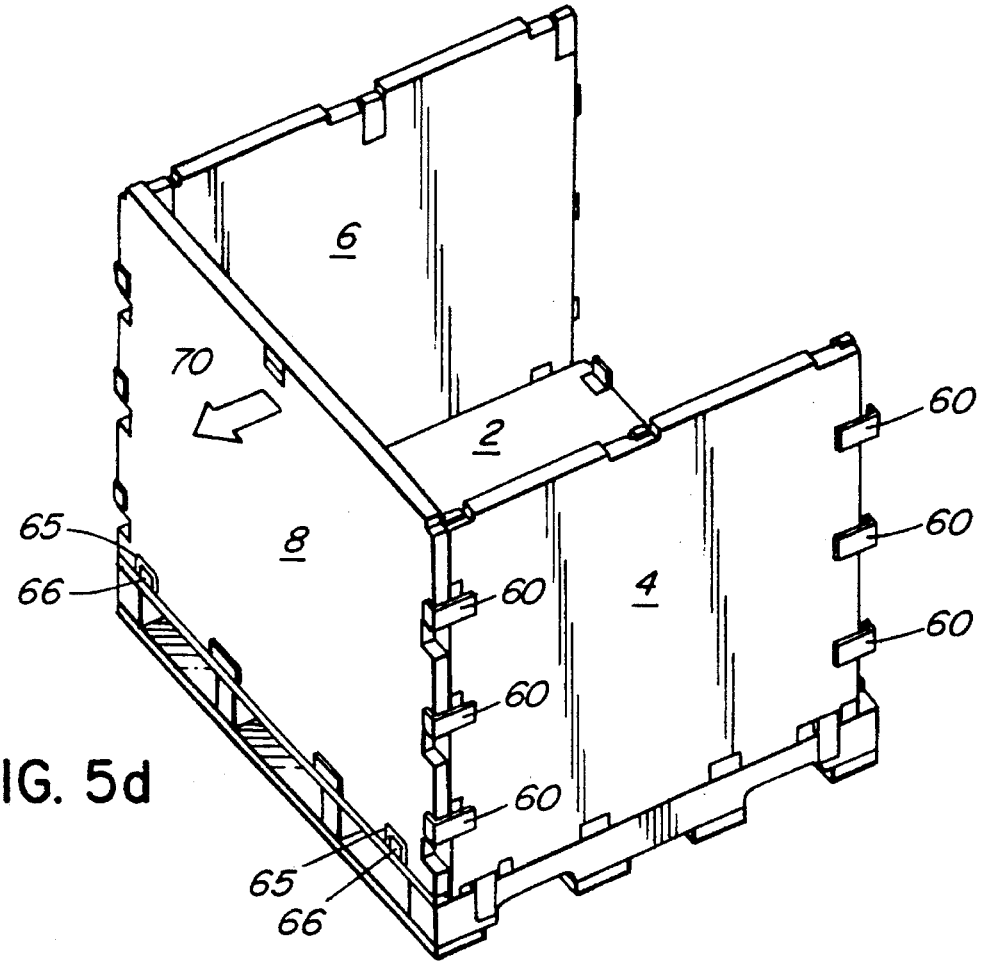
Figure 5H:
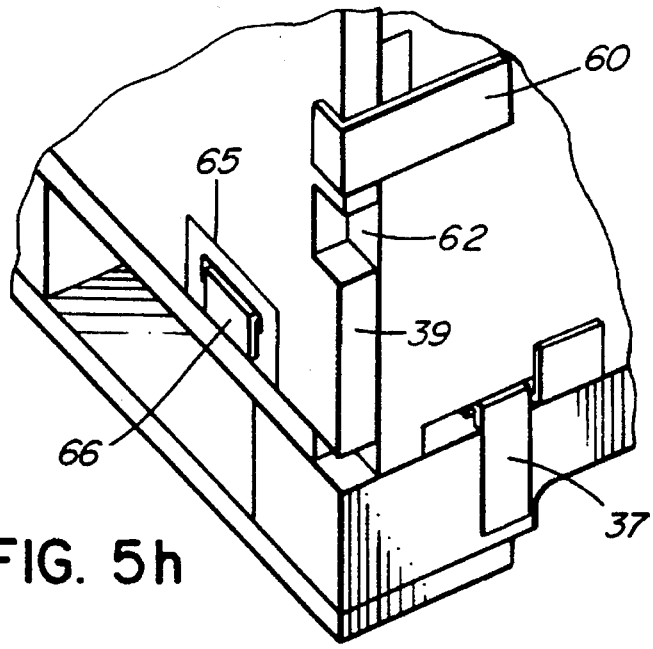

The final step is the movement of the two side walls and the first end wall as a unit from the intermediate position to a final position as indicated by arrows 70 in FIG. 5*d*. This movement results in hook members 66 of the base engaging in cavities 65 in the first end wall as best shown in FIG. 5*h*. The hook members 66 act to prevent upward movement of the first end wall with respect to the base and the side walls. The result is that both side walls and the first end wall are interlocked with the base. This unique arrangement of interlocking three walls to the base provides a very rigid container that is able to withstand a great deal of punishment. The interlocking of the three walls to the base is achieved solely by sliding movements of the walls alone and as a unit and requires no tools.

The final step to complete the walls of the container involves the insertion of second end wall 10 between the side walls at the other end of the container. Sufficient space remains on the base after movement of the side walls and the first end wall to the final position to receive the second end wall 10.

Figure 6A:
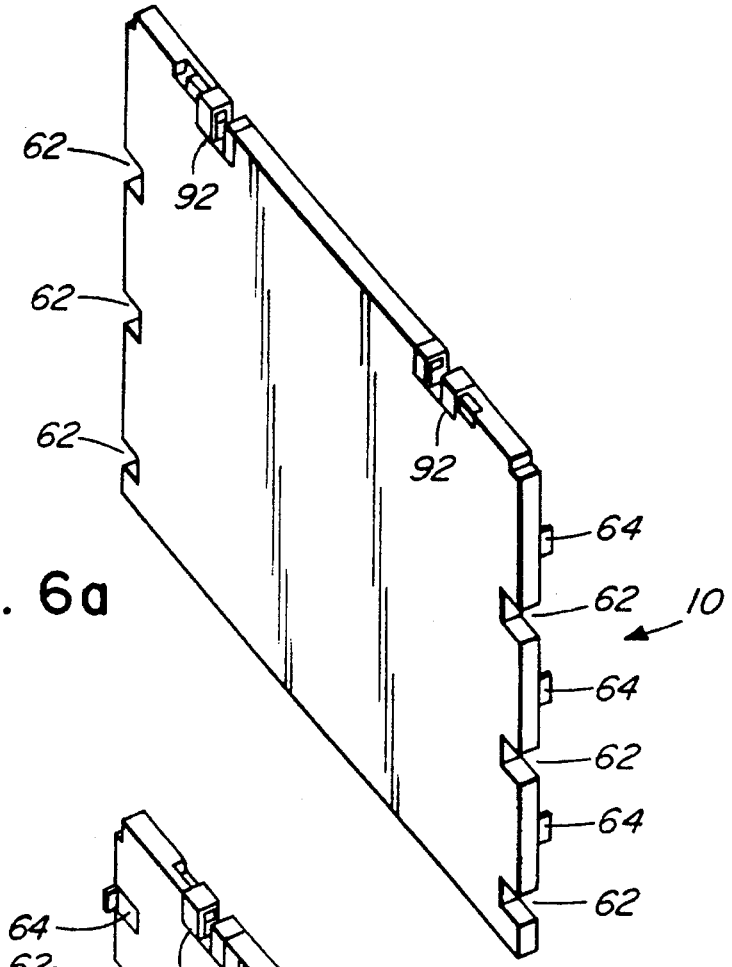
FIGS. 6*a* and 6*b* are perspective views of the second end wall.
Figure 6B:
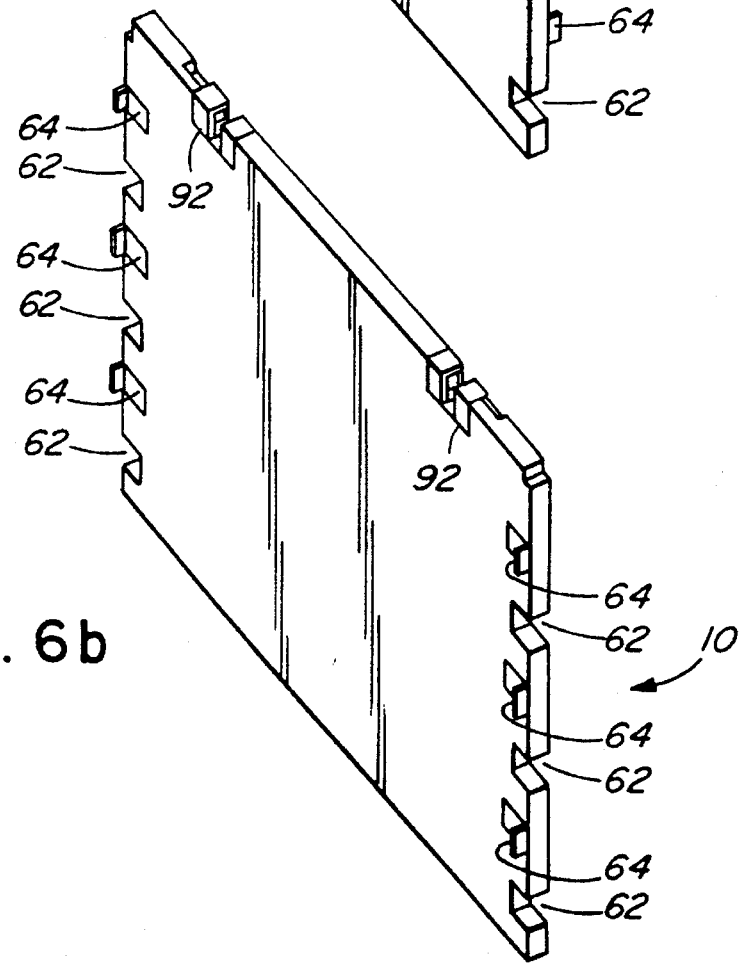

FIGS. 6*a* and 6*b* illustrate the outer and inner surfaces, respectively, of second end wall 10. Second end wall 10 is substantially similar to first end wall 8 and is connected to the side walls in the same manner as the first end wall by virtue of L-shaped members 60 on the side walls receiving the side edges of the second end wall. Second end wall 10 is not directly connected to the base and therefore does not require the cavities 65 that receive hook members 66. The second end wall does include cutaway section 62 and angle members 64.

Figure 7A:
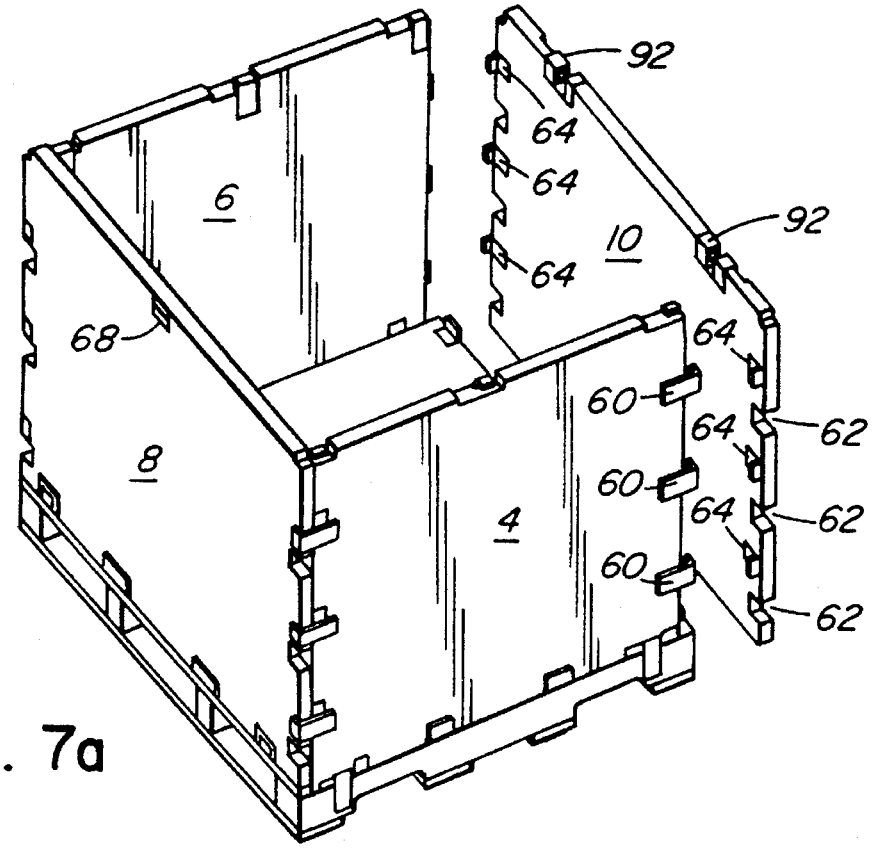
FIGS. 7*a*, 7*b* and 7*c* are detail view showing the engagement of the second end wall with the side walls.
Figure 7B:
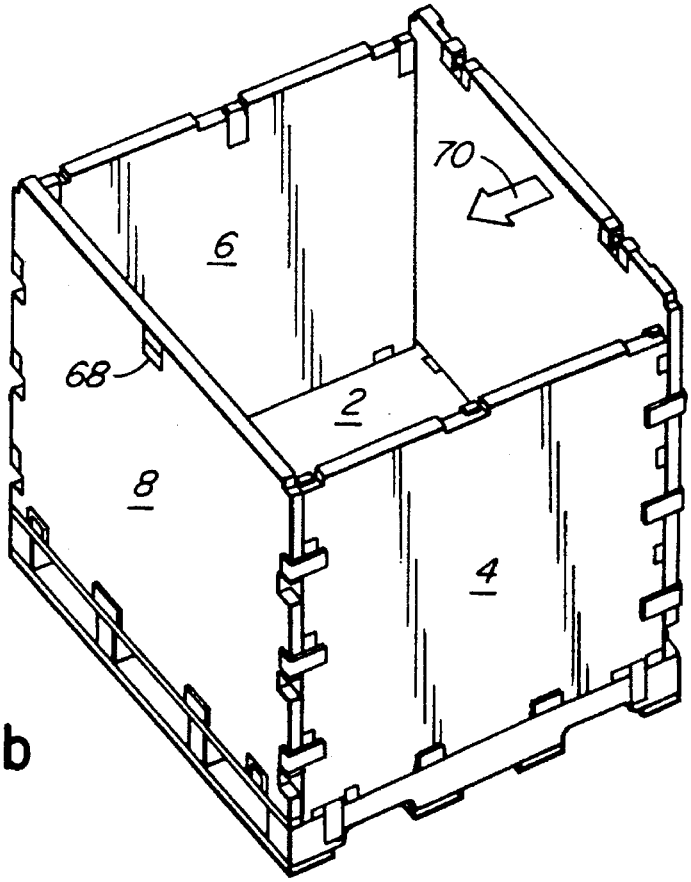
Figure 7C:
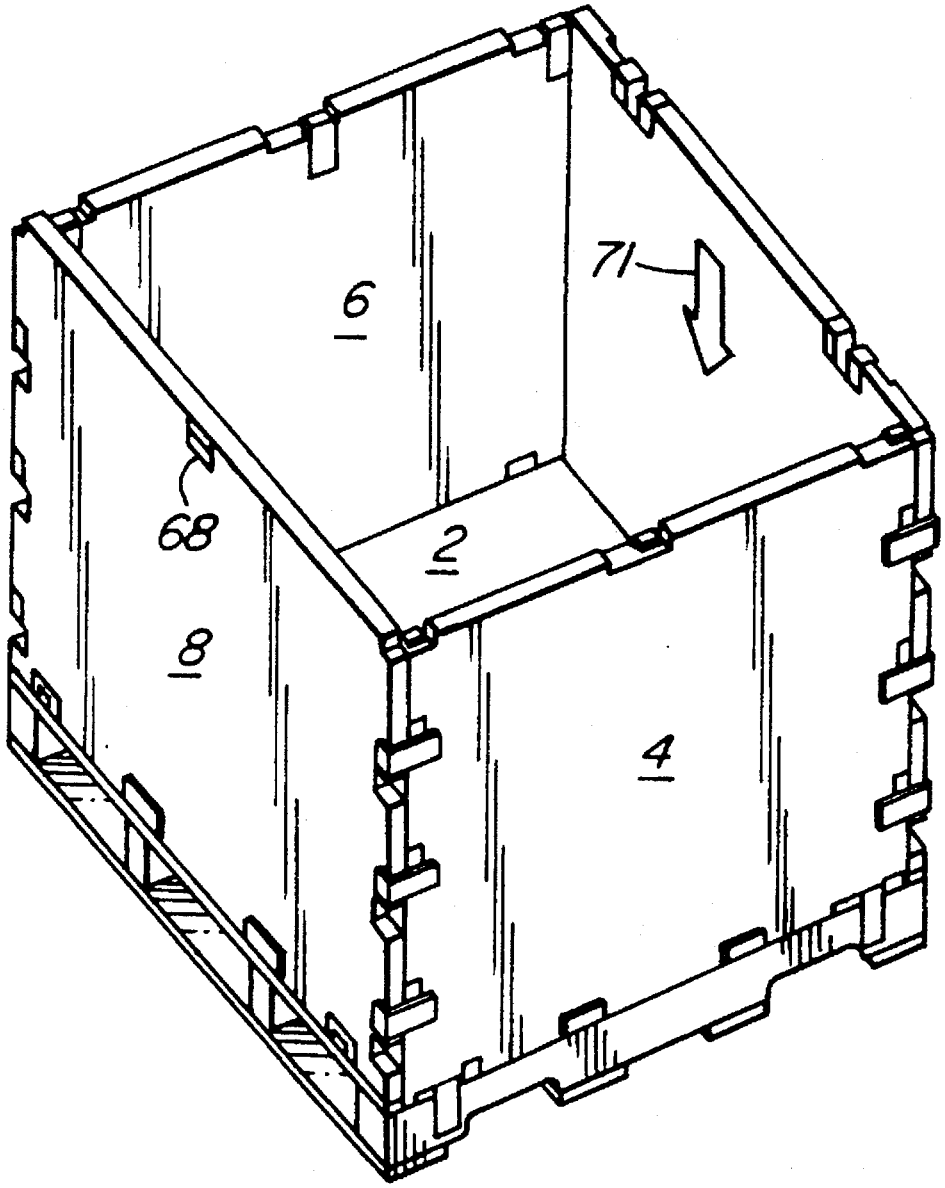

FIGS. 7*a* to 7*c* show the installation of the second end wall. End wall 10 is positioned to align cutaway sections 62 with angle members 60 as shown in FIG. 7*a*. The second end wall is moved inwardly, as indicated by arrow 70 in FIG. 7*b*, to move the L-shaped members through the cut away sections 62. As a final step the end wall is moved downwardly to rest on the base as indicated by arrow 71 in FIG. 7*c*. FIG. 7*c* shows the container assembled from base 2, side walls 4 and 6, first end wall 8 and second end wall 10. Angle members 60 of the side walls (FIGS. 2*a* and 2*b*) engage against the external surface of second end wall 10, and the angle members 64 of the second end wall engage against the external surface of the side walls so that the two walls support and brace each other. Preferably, as with the other sides of the base, upstanding tabs 56 are provided on the base to engage with the lower edge of the second end wall to prevent outward movement of the lower edge. The only possible movement for second end wall 10 is upwardly away from the base.

Figure 8A:
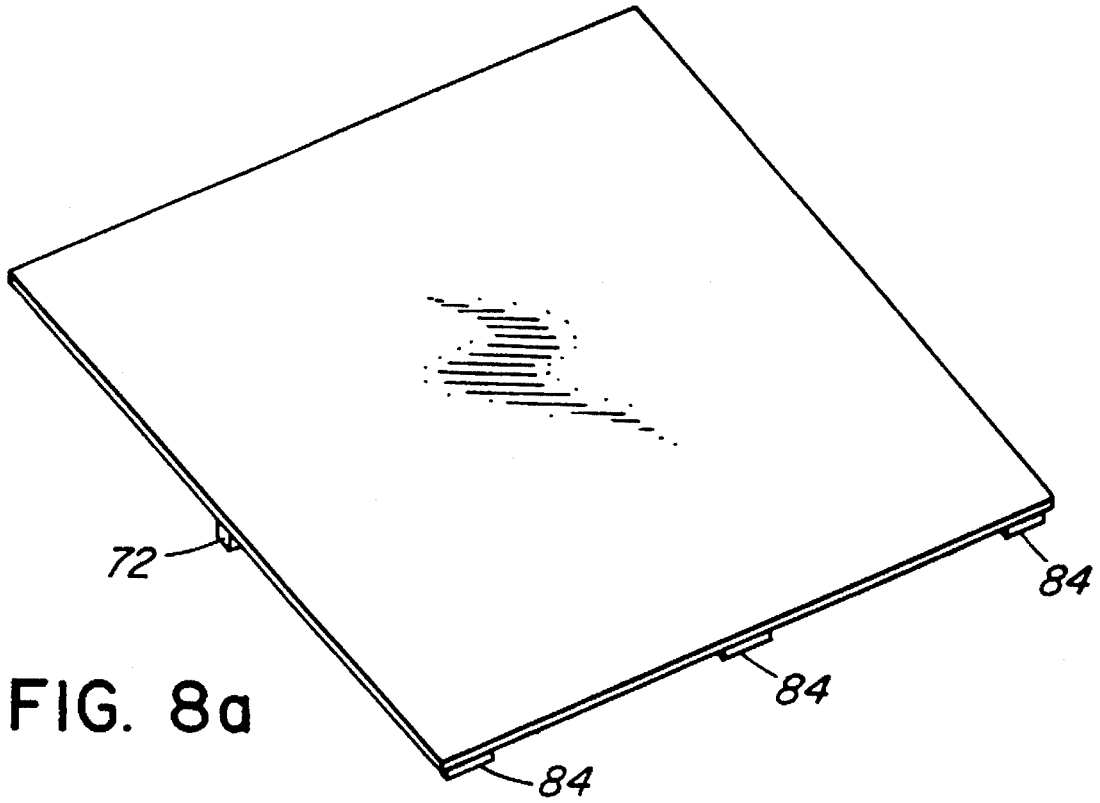
FIGS. 8*a* and 8*b* are perspective views of the cover of the container.
Figure 8B:
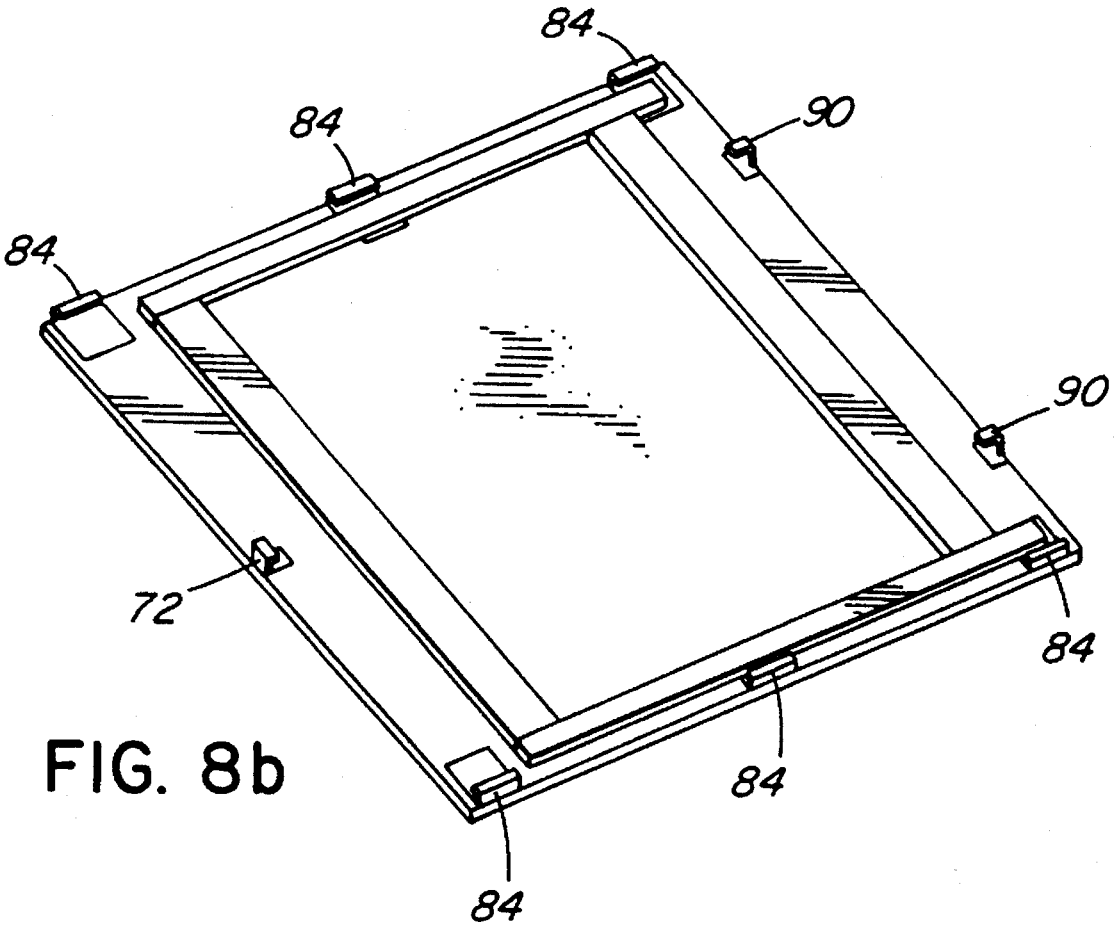

A cover 12 is preferably positionable atop the side walls and end walls to cover the open interior of the assembled container. When in place cover 12 also acts to prevent upward movement of second end wall 10. FIGS. 8*a* and 8*b* show the outer and inner surfaces respectively, of cover 12. Stiffening members 89 can be provided on the inner surface of the cover.

Means for releasably connecting the cover to the walls of the container are provided in the form of cooperating channel members and channel engaging members on the inner surface of the cover and the top edges of the walls. In the preferred embodiment, the channel members comprises a plurality of spaced, angle members 80 arranged along the top edges 34 of the side walls as best shown in FIGS. 2*a* and 2*b*. FIG. 9*g* shows a section through an angle member. Each angle member has an upper outwardly extending flange 81 that extends over the top edge 34 in spaced, parallel relation to the edge to create a channel between the flange and the top edge to receive the channel engaging member.

The channel engaging members comprises a plurality of U-shaped hook members 84 mounted to the lower surface of cover 12. FIG. 9*e* shows a section view through a hook member. Each hook member 84 has an inwardly extending flange 85 for slidable engagement in the channels defined by the angle members to interlock the cover with the side walls of the container. Each angle member 80 is mounted in an elongate cavity 82 on the top edge of the side walls and is positioned at one end of the cavity 82. The other end of the cavity is open to permit entry of the hook members 84 of the cover into the cavity for alignment with the angle members.

For additional securing of the cover to the container, first end wall 8 is provided with a cavity 68 adjacent a top edge and cover 12 is provided with a corresponding hook member 72 positioned to engage in cavity 68 when the cover is slid into place.

Figure 9A:
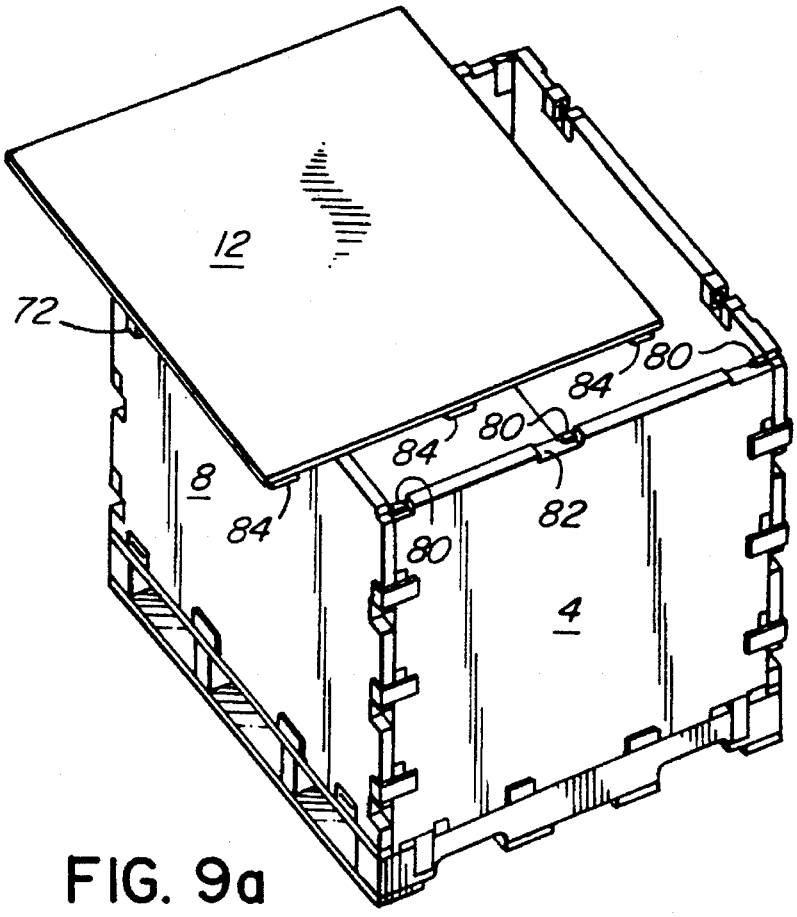
FIGS. 9*a*, 9*b* and 9*c* are perspective views of the cover being installed on the container.
Figure 9D:
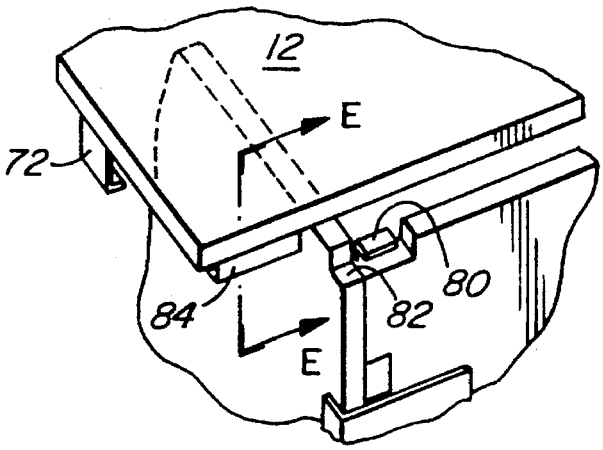
FIG. 9*d* is a detail view of FIG. 9*a;*
Figure 9E:
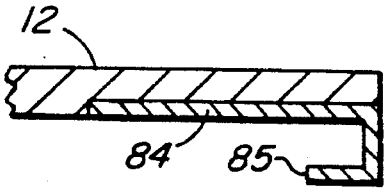
FIG. 9*e* is a section view taken along line E—E of FIG. 9*d;*
Figure 9B:
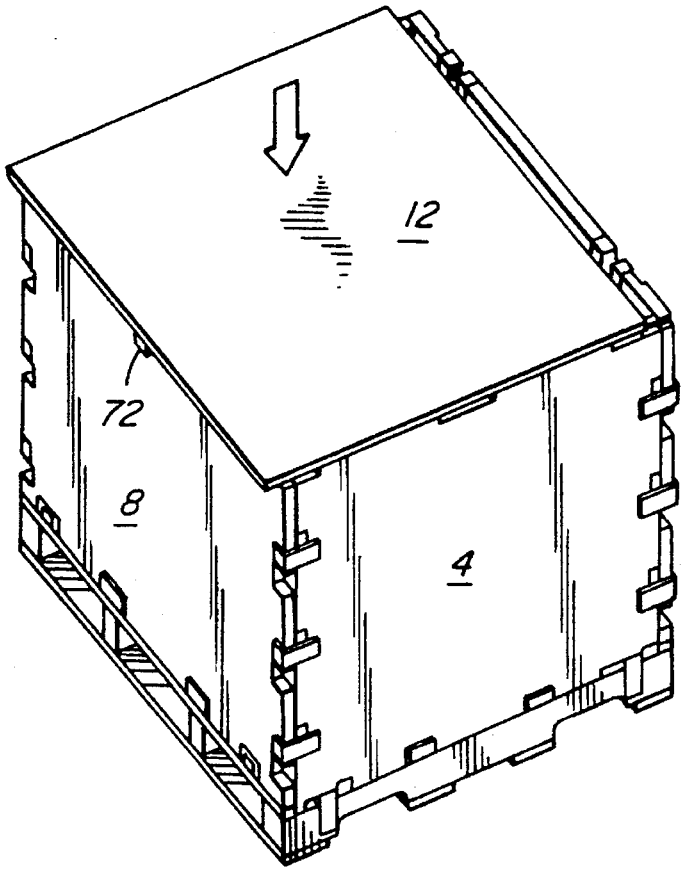
Figure 9F:
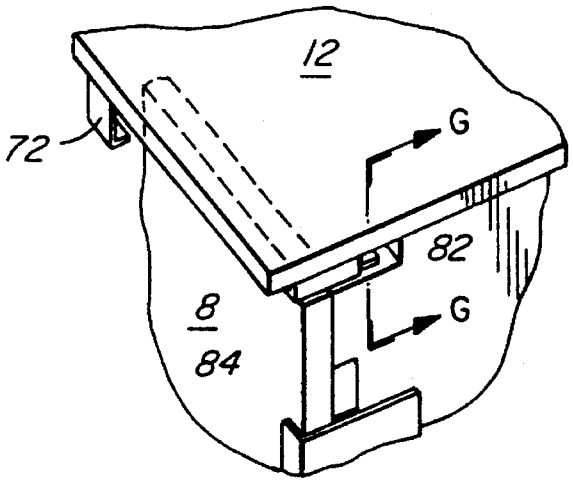
FIG. 9*f* is a detail view of FIG. 9*b;*
Figure 9G:
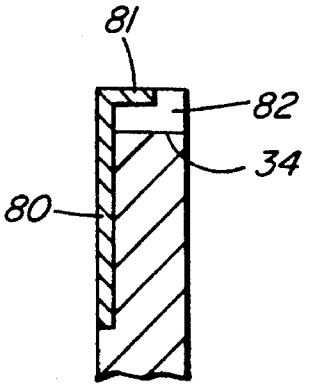
FIG. 9*g* is a section view taken along line G—G of FIG. 9*f;*
Figure 9C:
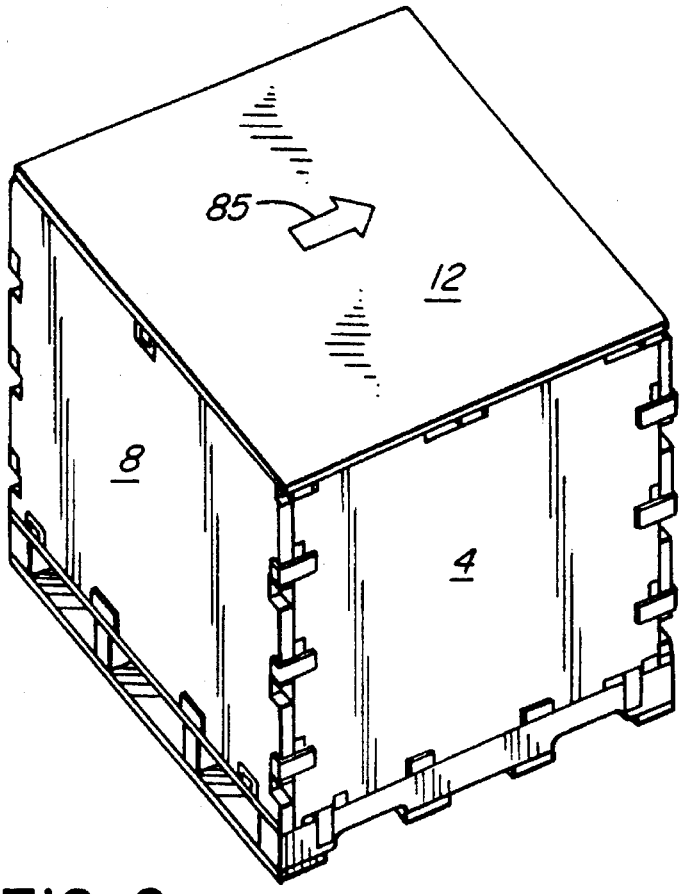
Figure 9H:
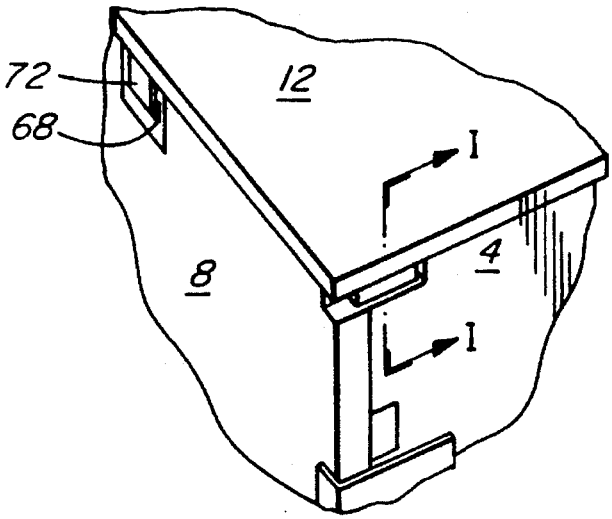
FIG. 9*h* is a detail view of FIG. 9*c;*
Figure 9I:
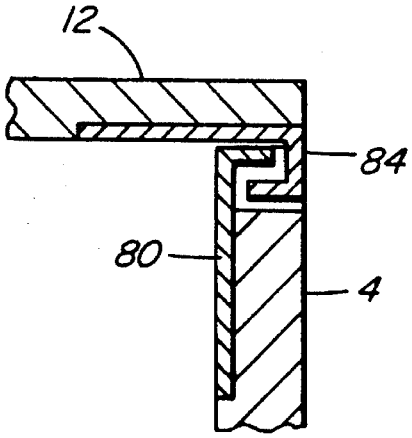
FIG. 9*i* is a section view taken along line I—I of FIG. 9*h;*

FIGS. 9*a* to 9*i* illustrate the steps necessary to connect cover 12 to the assembled container. Cover 12 is oriented with respect to the container (FIGS. 9*a* and 9*d*). Then cover 12 is lowered onto the walls of the container so that hook members 84 are introduced into the open ends of cavities 82 (FIGS. 9*b* and 9*f*). The cover is then slid in the direction of arrow 85 in FIG. 9*c* to engage the hook members 84 in the channels defined by angle members 80 to connect the cover with the walls as shown in detail in FIGS. 9*h* and 9*i*. At the same time, hook member 72 at the rear edge of the cover engages in cavity 68 in first end wall 8.

Figure 10:
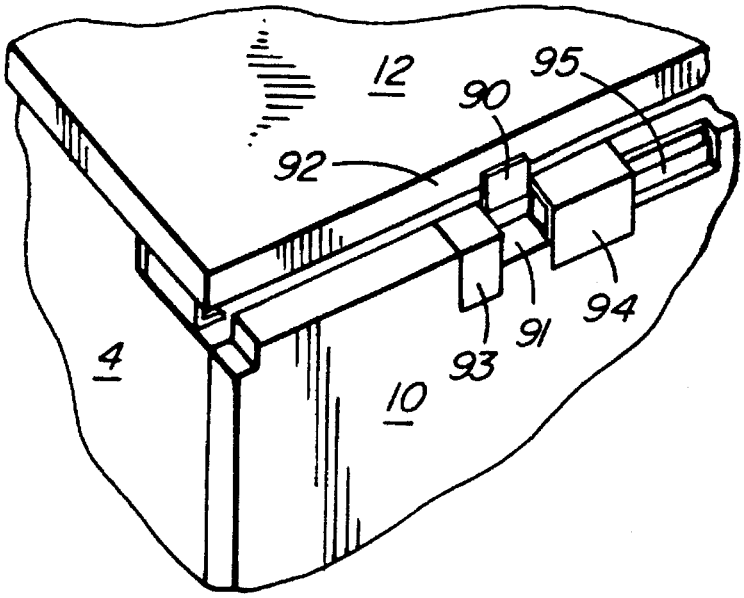
FIG. 10 shows the locking system for securing the cover to the assembled container.
Figure 11:
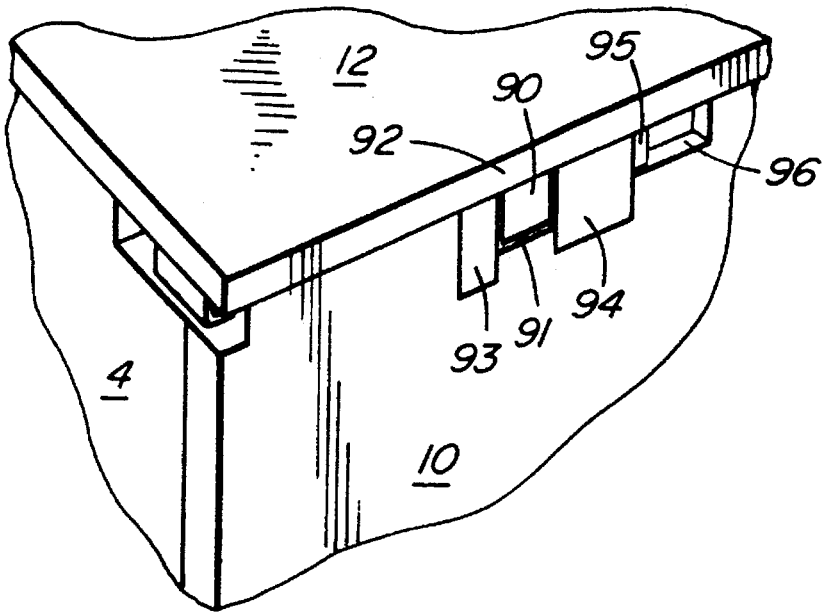
FIG. 11 shows the locking means in its locked position.
Figure 12:
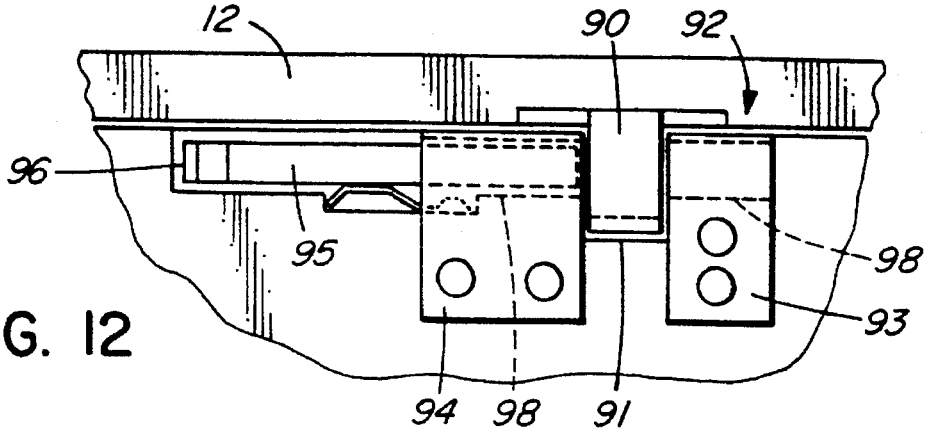
FIGS. 12 to 15 are detail views showing the apparatus and operation of the locking system.
Figure 13:
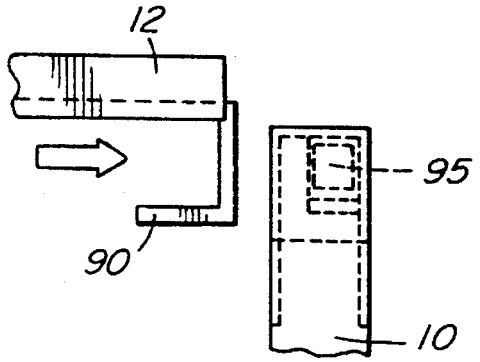
Figure 14:
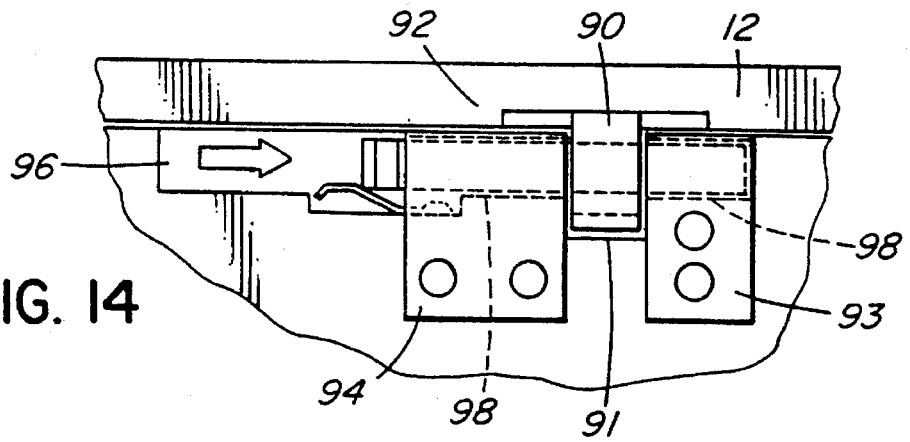
Figure 15:
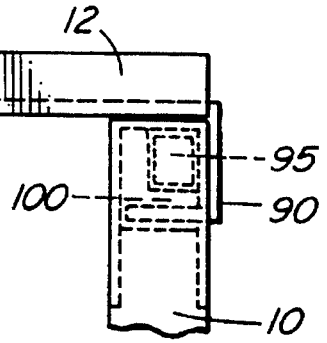

It is desirable that the container of the present invention include locking means to lock the cover to the walls so that any contents of the container are secured within the container. FIGS. 10 and 11 show preferred locking means comprising a latch member 90 attached to the cover and corresponding latch engaging means 92 mounted to the second end wall 10. FIGS. 12 to 15 provide detail views of the locking mechanism. Latch member 90 is a hook member mounted to the lower side of cover 12. A pair of latch members 90 are shown in FIG. 8*b* to be engaged by a pair of latch engaging means 92 mounted in the top edge of second end wall 10 as shown in FIGS. 6*a* and 6*b*. As best shown in FIG. 12, each latch engaging means comprises a pair of spaced housings 93 and 94 having aligned passages 98 therethrough to slidably accept bolt 95. Housings 93 and 94 are spaced to define a vertical slot 91 that is positioned to permit slidable movement of latch member 90 between the housings when cover 12 is slid into place. Initially, as shown in FIG. 12, bolt 95 is withdrawn from between the housings by movement into side passage 96 to allow latch member 90 of the cover to move between housing 93 and 94 in slot 91. As illustrated in FIG. 14, once the cover is in place, bolt 95 is pushed from side passage 96 to move through aligned passages 98 of the housings to extend through slot 91. As shown in FIG. 15, this positions bolt 95 through the U-shaped centre of latch member 90. Cover 12 resting atop second end wall 10 prevents upward movement of the second end wall with respect to the base and latch member 90 prevents outward movement of the top edge of the end wall. If desired, a conventional lock (not shown) can be inserted through the exposed end of bolt 95 in side passage 96 to lock the bolt in place until it is necessary to open the container.

Preferably, bolt 95 and latch member 90 are dimensioned to permit limited vertical movement of the cover with respect to the walls of the container to prevent the second end wall 10 from being pulled upwardly due to upward movement of the cover. In FIG. 15, a gap 100 is shown between the lower flange of latch member 90 and bolt 95. Slight movement of the cover is possible if there is an upward surge of liquid contents within the container during transport. In fact, the container of the present invention is particularly suited for shipping of bulk and liquid goods that tend to shift during transport. In addition, it is anticipated that the container of the present invention will be provided with a disposable liner so that the interior of the container is sealed.

The container of the present invention can be collapsed by reversing the steps required for assembly.

It is possible to use alternative connecting members to join together the base and walls of the container of the present invention. FIGS. 16–21 illustrate various alternative connecting members.

Figure 16:
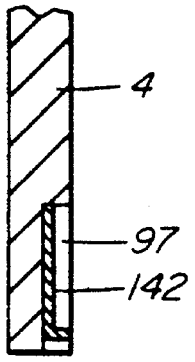
FIGS. 16 to 18 show alternative connecting means for attaching the side walls to the base.

FIG. 16 is a section view through a side wall showing an alternative angle member 142 that is equivalent to and functions in the same manner as the angle member 42 shown in FIG. 3*e*. Angle member 142 of FIG. 16 is mounted to the external surface of side wall 4 within a depression 97 adjacent the lower edge of the side wall.

Figure 17:
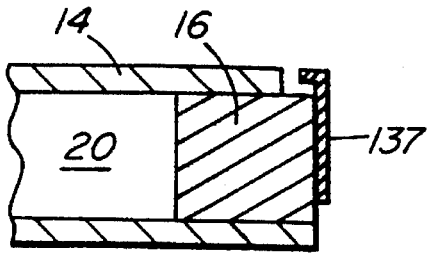

FIG. 17 shows an alternative angle member 137 that is equivalent to and functions in the same manner as the angle member 37 shown in FIG. 3*g*. Angle member 137 has a shorter upper flange extending over the base to accommodate the angle member 142.

Figure 18:
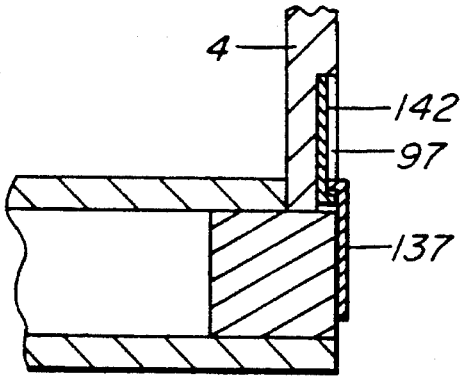

FIG. 18 shows the manner in which the alternative angle members 142 and 137 slidably interlock to connect side wall 4 to base 2.

Figure 19:
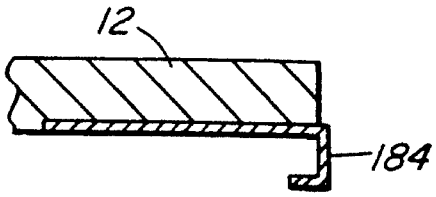
FIGS. 19 to 21 show alternative connecting means for attaching the cover to the container.
Figure 20:
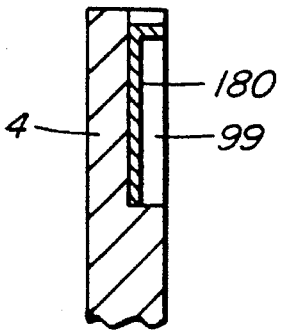
Figure 21:
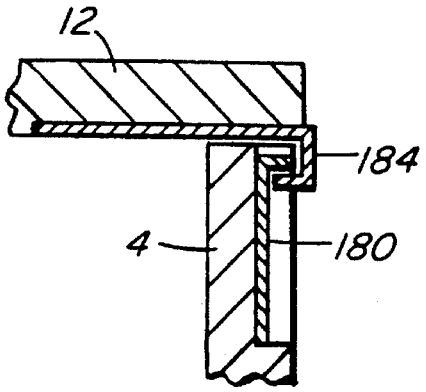

FIG. 19 illustrates an alternative hook member 184 that is equivalent to the hook member 84 shown in FIG. 9*e* and FIG. 20 illustrates an alternative angle member 180 that is equivalent to the angle member 80 shown in FIG. 9*g*. Angle member 180 is mounted in a depression 99 in the outer surface of the side wall adjacent an upper edge. FIG. 21 shows how hook member 184 and angle member 180 slidably interlock. Note in the arrangement of FIG. 21 that hook member 184 extends outwardly past the edge of cover 12 and the plane of side wall 4 in order to engage with angle member 180 in depression 92.

Figure 22A:
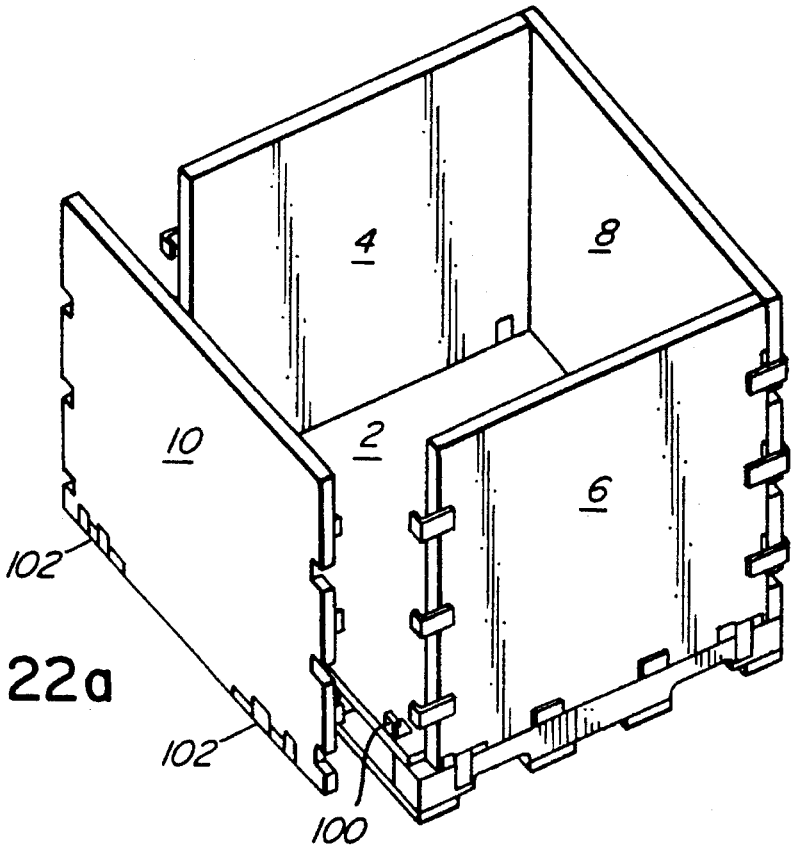
FIGS. 22*a*, 22*b* and 22*c* shows an alternative locking system for attaching the second end wall to the base.
Figure 22B:
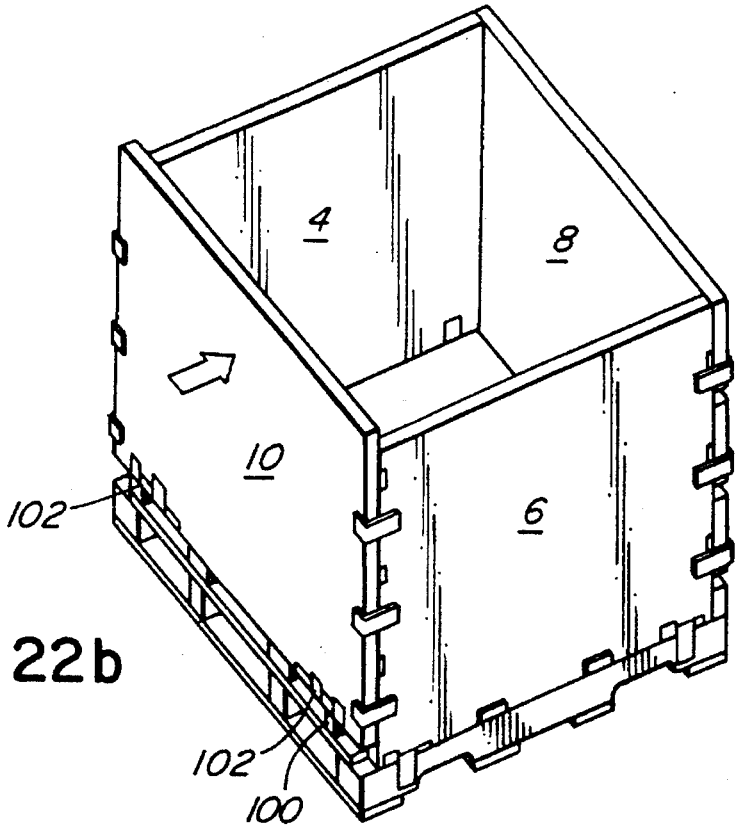
Figure 22C:
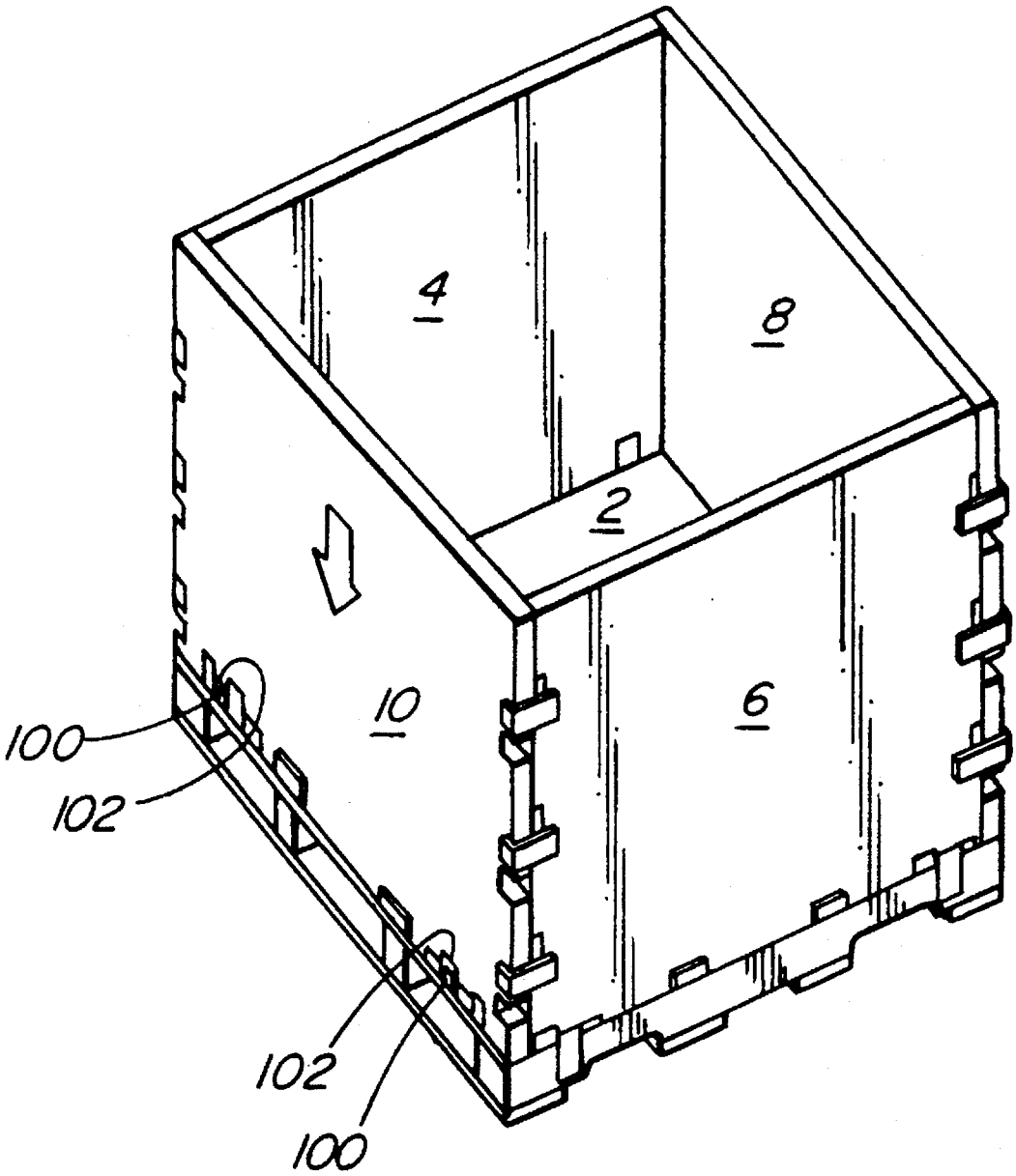

It is anticipated that a user might want to use the container of the present without a cover. Such situations might arise when there is a need for a low height bin to carry a low weight cargo. Since cover 12 holds second end wall 10 in place on the base, a coverless container according to the present invention includes locking means to secure the second end wall to the base. FIGS. 22*a*–22*c* illustrate such locking means and the manner in which second end wall 10 is moved into position. In FIGS. 22*a*–22*c*, the container has been rotated through 180 degrees from its position shown in FIGS. 7*a*–7*c* so that the details of the locking mechanism and second end wall 10 are clearly visible. The locking mechanism for securing the second end wall 10 to the base 2 comprises an arrangement identical to the locking mechanism shown in FIGS. 12–15. Instead of being formed on the cover and the top edge of the second end wall, the present locking mechanism is mounted to the base and the lower edge of the side wall. As best shown in FIG. 22*a*, a pair of hooked latch members 100 are mounted to base 10. The lower edge of second end wall 10 is provided with corresponding paired sets of housings 102. Each set of housings 102 has an associated bolt and each set of housings is spaced to receive a latch member 100 therebetween. As shown in FIGS. 22*b* and 22*c*, second end wall 10 is moved into position, aligned and lowered to base 2. Hooked latch members 100 on the base are received in the housings 102 on the lower edge of the second end wall. The bolts associated with the sets of housings are slid into place to secure the second end wall 10 to the base.

Although the present invention has been described in some detail by way of example for purposes of clarity and understanding, it will be apparent that certain changes and modifications may be practised within the scope of the appended claims.

I claim:

1. A container comprising:

a base, a pair of side walls, and first and second end walls;

means for releasably connecting the pair of side walls to the base by slidable movement of the side walls from a first position to an intermediate position and then to a final position on the base;

means for releasably connecting the side walls to the first and second end walls; and means for releasably connecting the first end wall to the base after the first end wall has been connected to the side walls when the side walls are in their intermediate position by slidable movement of the pair of side walls and the first end wall as a unit over the base to the final position of the side walls whereupon the second end wall is releasably connected to the side walls atop the base to complete the container.

2. A container as claimed in claim 1 in which the means for releasably connecting each of the pair of side walls to the base comprises:

channel means and channel engaging members on the base and side walls, the channel engaging members adapted for slidable engagement in the channel means to interlock the side wall to the base so that the side wall extends substantially perpendicular to the base.

3. A container as claimed in claim 2 in which the channel means comprises:

at least two spaced, angle members arranged along each side of the base, each angle member having an upper inwardly extending flange that extends over the base in spaced, parallel relation to the base to create a channel between the flange and the base to receive the channel engaging members.

4. A container as claimed in claim 3 in which the channel engaging members comprise:

at least two spaced, L-shaped angle members on the side wall adjacent a lower edge of the side wall, each angle member having a lower outwardly extending flange for slidable engagement in the channel.

5. A container as claimed in claim 1 in which the base includes slots for guiding slidable movement of each side wall, each slot including a first substantially vertical surface to prevent inward movement of the side wall with respect to the base, a substantially horizontal surface to support the lower edge of the side wall and a second substantially vertical surface to prevent outward movement of the side wall with respect to the base.

6. A container as claimed in claim 1 in which the means for releasably connecting the side walls and the first and second end walls comprises:

channel means along the side edges of the side walls adapted to slidably receive the side edges of the end walls; and bracing means associated with the first and second end walls to engage and support the side walls.

7. A container as claimed in claim 6 in which the channel means comprises a plurality of L-shaped members mounted at spaced intervals adjacent the side edges of each side wall, each member having a terminal flange extending parallel to the side edge of the side wall to define a pocket between the flange and the side edge for receiving and retaining a portion of the side edge of an end wall.

8. A container as claimed in claim 7 in which each end wall is formed with a plurality of cutaway sections adjacent the side edges, the cutaway sections being dimensioned and positioned to accommodate movement of the end wall side edges past the L-shaped members into the channels means for slidable movement of the end wall toward the base.

9. A container as claimed in claim 6 in which the bracing means comprises a plurality of angle members mounted adjacent the side edges of each end wall adapted to engage against adjacent side walls to brace the side walls to prevent outward movement of the side walls with respect to the base.

10. A container as claimed in claim 1 in which the means for releasably connecting the first end wall to the base comprises:

at least one cavity and at least one hook member formed on the first end wall and the base and positioned such that the at least one hook member engages in the at least one cavity when the first end wall and the pair of side walls are moved as a unit to the final position to prevent upward movement of the first end wall with respect to the base and the side walls.

11. A container as claimed in claim 10 in which the at least one cavity is formed in the first end wall and the at least one hook member is mounted to the base.

12. A container as claimed in claim 1 in which the base includes passages extending between opposite sides of the base to receive fork lift equipment and permit lifting of the container from any of the four sides.

13. A container as claimed in claim 1 including a cover positionable atop the side walls and end walls and means for releasably connecting the cover to the walls of the container.

14. A container as claimed in claim 13 in which the means for releasably connecting the cover to the walls comprises:

co-operating channel members and channel engaging members on the cover and the top edges of the walls, the channel engaging members adapted for slidable engagement in the channel members to interlock the cover with the walls of the container, the cover extending over the second end wall to locate said wall on the base.

15. A container as claimed in claim 14 in which the channel members comprises a plurality of spaced, angle members arranged along the top edge of the side walls, each angle member having an upper outwardly extending flange that extends over the top edge in spaced, parallel relation to the edge to create a channel between the flange and the top edge to receive the channel engaging member.

16. A container as claimed in claim 14 in which the channel engaging members comprises a plurality of U-shaped hook members mounted to the lower surface of the cover, each hook member having an inwardly extending flange for slidable engagement in the channels.

17. A container as claimed in claim 13 including locking means to secure the cover to the walls.

18. A container as claimed in claim 17 in which the locking means comprise at least one latch member and corresponding latch engaging means mounted to the cover and one of the walls such that the at least one latch members is held by the latch engaging means when the cover is positioned on top of the walls of the container.

19. A container as claimed in claim 18 in which the at least one latch member is mounted to the cover and the latch engaging means are mounted to the second end wall.

20. A container as claimed in claim 18 in which the at least one latch member, the latch engaging means, the channel members and the channel engaging members are positioned and dimensioned to permit limited movement of the cover with respect to the walls.

21. A container as claimed in claim 1 including locking means for securing the second end wall to the base.

* * * * *